US012578089B1

(12) United States Patent
Phillips et al.

(10) Patent No.: US 12,578,089 B1
(45) Date of Patent: Mar. 17, 2026

(54) SYSTEMS FOR CARRYING, TRANSPORTING, DEPLOYING AND SERVICING A FLARE STACK

(71) Applicant: Jason Ferguson, Robstown, TX (US)

(72) Inventors: Joel Phillips, Corpus Christi, TX (US); Kevin Baker, Luling, TX (US)

(73) Assignee: Jason Ferguson, Robstown, TX (US)

( * ) Notice: Subject to any disclaimer, the term of this patent is extended or adjusted under 35 U.S.C. 154(b) by 509 days.

(21) Appl. No.: 17/962,525

(22) Filed: Oct. 9, 2022

Related U.S. Application Data

(60) Provisional application No. 63/254,676, filed on Oct. 12, 2021.

(51) Int. Cl.
*F23G 7/08* (2006.01)

(52) U.S. Cl.
CPC ..... *F23G 7/085* (2013.01)

(58) Field of Classification Search
CPC ..... F23G 7/085; F23G 5/40; F23G 2203/601; F23G 2203/60
USPC ..... 431/202; 110/240, 184; 166/77.52; 173/184–185, 28
See application file for complete search history.

(56) References Cited

U.S. PATENT DOCUMENTS 4,368,602 A * 1/1983 Manten ..... E21B 7/024 173/28
5,429,496 A * 7/1995 Stephens ..... F23G 7/085 431/279
5,803,726 A * 9/1998 Bacon ..... F23G 7/085 431/264
5,848,884 A * 12/1998 Haustein ..... F23G 7/085 431/258

* cited by examiner

*Primary Examiner* — Vivek K Shirsat
(74) *Attorney, Agent, or Firm* — E. Randall Smith; E. Randall Smith, P.C.

(57) ABSTRACT

In some embodiments, systems, apparatus and methods for erecting a flare stack into at least one upright operating position includes a flare stack transporter configured to carry the flare stack in one or more lowered positions. At least a first retractor can be selectively actuated to help draw at least part of the flare stack in a first direction and at least a first guide can be used to help move at least part of the flare stack in a second direction until the flare stack is in at least one upright operating position.

24 Claims, 25 Drawing Sheets

SYSTEMS FOR CARRYING, TRANSPORTING, DEPLOYING AND SERVICING A FLARE STACK

CROSS REFERENCE TO RELATED APPLICATIONS

The present application claims priority to U.S. Provisional Patent Application Ser. No. 63/254,676 filed on Oct. 12, 2021 and entitled "Systems, Apparatus & Methods for Carrying, Transporting, Erecting, Lowering and Servicing a Flare Stack and Associated Igniter(s)", the entire contents of which are hereby incorporated by reference herein.

FIELD OF THE DISCLOSURE

The present disclosure relates generally to flare stacks, and in some embodiments, systems, apparatus, and methods for carrying, transporting, erecting, lowering or servicing a flare stack and/or one or more igniters or other components associated therewith, or a combination thereof.

BACKGROUND

Flare stacks, sometimes called gas flares, flare booms, flare systems and the like, are gas combustion devices often used for burning off unwanted flammable gases at petroleum refineries, chemical plants, natural gas processing plants, oil and gas extraction sites, offshore oil and gas rigs, landfills and/or other sites. The flare stack typically includes an elevated vertical pipe having an igniter near its upper end so that ignition and combustion of the discharged gas takes place at a considerable heigh (e.g., 30-40 feet).

Presently known flare stack deployment, handling, inspection and repair techniques are believed to have one or more disadvantages. For example, various known techniques are difficult, cumbersome, time-consuming and require numerous personnel and dedicated heavy equipment throughout the process. Typically, the flare stack is hooked up to a sling, lifting saddle or the like carried by a forklift, telehandler or other heavy equipment and hoisted up into a vertically-oriented position, sometimes up to 40-50' height, then driven to the desired site. The vertical flare stack often dangles off the forks by the strap (or other carrier) and is subject to swaying (e.g., due to wind, uneven terrain, etc.) while being driven to the desired position. With the flare stack in that precarious situation and during its transport, at least a second person is typically on the ground in the vicinity of the flare stack holding a line connected to the flare stack (bottom) to help stabilize it during delivery, or otherwise helping steady, guide and position the flare stack. At least a third person (spotter) is often needed to watch and direct the driver.

Securing the flare stack in an operating position and connecting it to the drilling rig flare pipe or other component(s) may likewise be difficult and cumbersome. Typically, with the flare stack held up vertical, one or more personnel may be needed to connect guide wires, T-stands or other components to help secure or anchor the flare stack and bolt it to the drilling rig flare pipe or other components. When the job is completed, the process is reversed, often requiring the same number of personnel and heavy equipment to disconnect and lay the flare stack down and then rig it up and haul it to the next location. For another example, in many instances, inspecting, servicing or replacing the igniter or other components near the upper end of the flare stack often requires personnel at the height of the top of the vertical flare stack.

Accordingly, there exists a need for apparatus, systems and methods for carrying, transporting, erecting, lowering or servicing a flare stack and/or related components that is quick, easy, may be performed by as few and one person, may be at least partially automated and/or remotely (e.g., wirelessly) controlled, does not require dedicated heavy equipment throughout the process, carries the flare stack securely anchored to a skid or other base that provides stability throughout transport and operation, transports the flare stack to the job site in a lowered and stable position and not dangling overheard or subject to swaying and dislodging (e.g., due to wind, uneven terrain, etc.), allows the flare stack to be easily and quickly coupled to a drilling rig flare pipe (or other component(s)) before being stood up vertical, allows the flare stack and igniters to be serviced at or near ground level quickly and without the need for heavy equipment, allows the flare stack to be raised and lowered (e.g., remotely) without heavy equipment or the need to shut down drilling (or other) operations, has other benefits or advantages described below, shown in the appended drawings or as may be evident from any part of this patent, or a combination thereof.

It should be understood that the above-described disadvantages, limitations, features, capabilities, examples, advantages and other details are provided for illustrative purposes only and are not intended to limit the scope or subject matter of this disclosure or the appended claims. Thus, none of the appended claims should be limited by the above discussion or construed to address, include or exclude each or any of the above-cited disadvantages, limitations, features, capabilities, examples, details or advantages merely because of the mention thereof above.

BRIEF SUMMARY OF EXEMPLARY EMBODIMENTS

In some embodiments, the present disclosure involves systems for erecting a flare stack into at least one upright operating position, the flare stack having upper and lower ends. These systems include a flare stack transporter having front and rear ends, wherein the flare stack can be carried on the transporter in a lowered position with its upper end closest to the rear end of the transporter and its lower end is closest to the front end of the flare stack transporter. At least a first retractor is mounted on the transporter and associated with the flare stack. The first retractor can be selectively actuated to help draw the lower end of the flare stack rearward in the direction of the rear end of the transporter. At least a first guide is mounted on the transporter and associated with the flare stack and used to help guide the upper end of the flare stack upwardly into at least one upright operating position. If desired, the first guide can help move the upper end of the flare stack upwardly concurrently with the rearward movement of the lower end of the flare stack.

In various embodiments, systems for raising and lowering a flare stack igniter relative to an upright flare stack include a flare stack ignition boom carrying the flare stack igniter and being separate and distinct from the flare stack. At least one connector is coupled between the flare stack and the flare stack ignition boom closer to the lower end than the upper end of the flare stack ignition boom. The connector is configured to allow the flare stack ignition boom to be selectively movable relative to the flare stack so that the igniter can be lowered and raised relative to the upright flare stack. At least one controller is coupled to the flare stack ignition boom and may be selectively actuated to lower and raise the flare stack igniter relative to the upright flare stack.

Accordingly, the present disclosure includes features and advantages which are believed to enable it to advance flare stack technology. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF EXEMPLARY EMBODIMENTS

Figure 1:
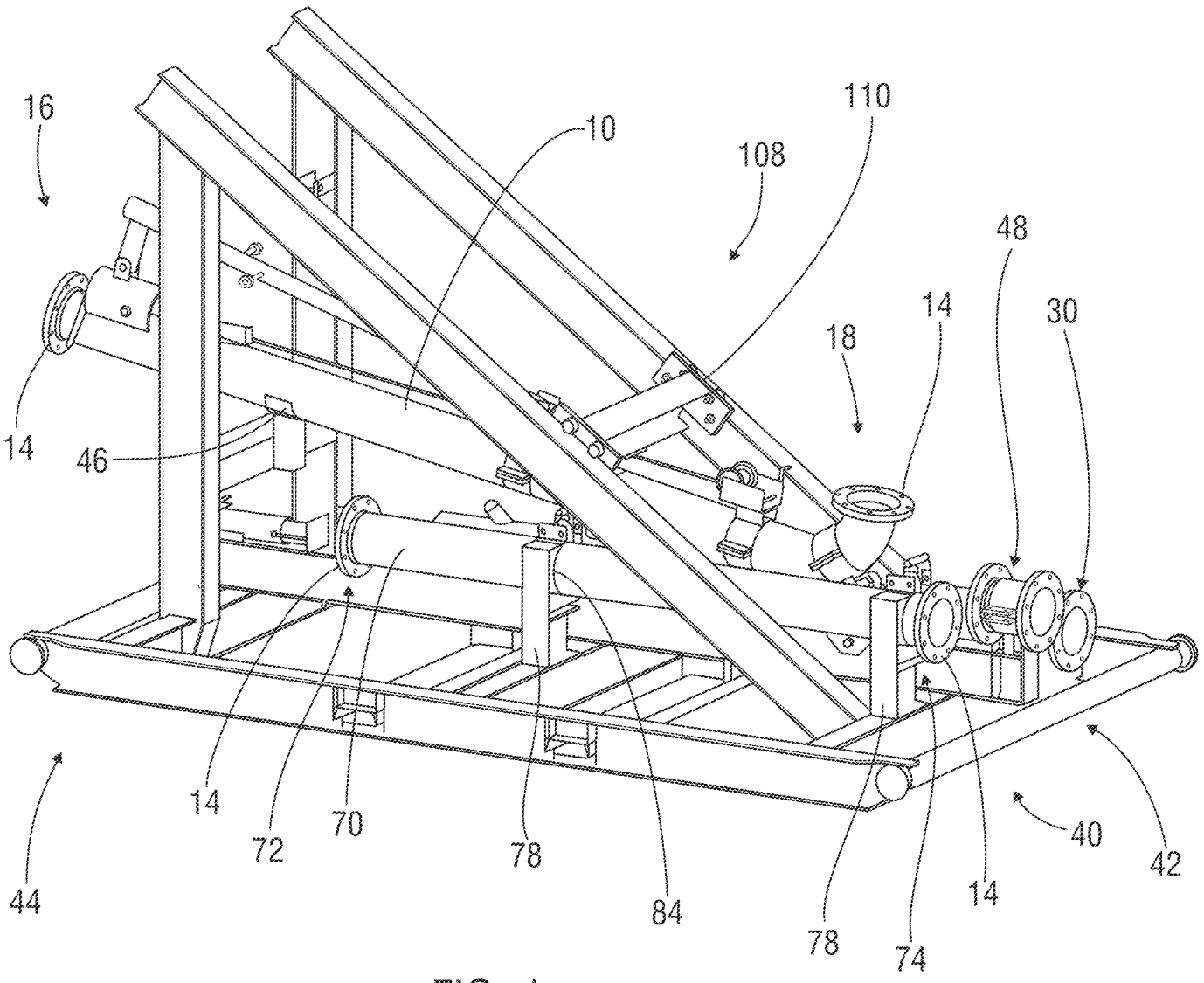
FIG. 1 is a perspective view of an exemplary flare stack transporter showing an exemplary flare stack in a lowered position in accordance with one or more embodiments of the present disclosure.

Characteristics and advantages of the present disclosure and additional features and benefits will be readily apparent to those skilled in the art upon consideration of the following detailed description of exemplary embodiments and referring to the accompanying figures. It should be understood that the description herein and appended drawings, being of exemplary embodiments, are not intended to limit the claims of this patent (or any patent or patent application claiming priority hereto). On the contrary, the intention is to cover all modifications, equivalents and alternatives falling within the spirit and scope of this disclosure and/or the claims. Many changes may be made to the particular embodiments and details disclosed herein without departing from such spirit and scope.

In showing and describing preferred embodiments in the appended figures, common or similar components, features and elements are referenced with like or identical reference numerals or are apparent from the figures and/or the description herein. The figures are not necessarily to scale and certain features and certain views of the figures may be shown exaggerated in scale or in schematic in the interest of clarity and conciseness.

When reference numbers are followed by a lowercase letter (e.g., connectors 110*a*, 110*b*), they are each the same type of component or item (e.g., a connector 110) having the same features, but having a different location, use or other characteristic(s). As used herein and throughout various portions (and headings) of this patent (including the claims), the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference.

Certain terms are used herein and in the appended claims to refer to particular features and components. As one skilled in the art will appreciate, different persons may refer to a feature or component by different names and this document does not intend to distinguish between components and features that differ in name but not function. Also, the terms "including" and "comprising" are used herein and in the appended claims in an open-ended fashion, and thus should be interpreted to mean "including, but not limited to . . . ".

Reference herein and in the appended claims to components, features and aspects in a singular tense does not necessarily limit the present disclosure or appended claims to only one such component, feature or aspect, but should be interpreted generally to mean one or more, except and only to the extent as may be expressly specified otherwise herein or in any particular claims hereof and only for such specific references or claims and other claims depending therefrom. The use of "(s)" in reference to an item, aspect, component, feature or action (e.g., "surface(s)") should be construed to mean "at least one".

The term "and/or" as used herein provides for three distinct possibilities: one, the other or both. All three possibilities do not need to be available-only any one of the three. For example, if an embodiment of a component is described as "having a collar and/or a coupling", it may include only one or more collars, only one or more couplings or at least one of each. Thus, the use of "and/or" herein does not require all three possibilities, just any one or more of the three possibilities. A claim limitation that recites "having a collar and/or a coupling" would be literally infringed by a device including only one or more collars, one or more couplings or both one or more couplings and one or more collars. The phrase "at least one among" has the same meaning as "and/or". For example, if an embodiment of a component is described as "having at least one among a collar, a coupling and a connector", it may include only one or more collars, only one or more couplings, only one or more connectors or any combination thereof. Thus, the use of "at least one among" herein and in any claims related hereto does not require all those possibilities to be available, just any one or more of them.

As used throughout this patent, the following terms have the following meanings, except and only to the extent as may be expressly specified otherwise:

The terms "automated" and variations thereof as used herein refer to and mean being capable of operating or performing one or more tasks with minimal or no human intervention. Some examples of automation involve the use of one or more electronic devices (e.g., computers, robotics, AI, IoT).

The terms "beam", "rod" and variations thereof mean and include at least one at least partially solid and/or hollow rod, beam, tube, pipe, other elongated member constructed of any suitable material, or a combination thereof.

The terms "connector", "coupling" and the like, and variations thereof, mean and include any form of hardware or configuration of components that causes the referenced items to be connected together. The present disclosure is thus not limited to the specific types of couplings and connectors shown in the appended drawings.

The terms "coupled", "connected", "engaged" and the like, and variations thereof refer to and include either an indirect or direct connection or engagement. Thus, if a first device couples to a second device, that connection may be through a direct connection, or through an indirect connection via other devices and/or connections, except and only to the extent as may be expressly specified otherwise herein or in any particular claims hereof and only for such specific references or claims and other claims depending therefrom.

The terms "elongated" and variations thereof as used herein mean and refer to an item having an overall length (during the intended use of the item) that is greater than its average width.

The terms "for example, "e.g.,", "such as" and variations thereof are used to provide one or more possible examples of the referenced feature or circumstance that may occur in some instances. Such examples are not required for every embodiment or any claims, except and only the extent as may be explicitly provided otherwise.

The terms "generally", "substantially", "substantial" and variations thereof mean at least 50%.

The terms "minimal" and variations thereof mean no more than 5-10%.

The terms "party", "user", "entity", "person", "operator", "assembler", "manpower", "labor" and the like refer to and include one or more humans, legal entities, virtual entities, beings and avatars, robots and robotic components, artificial intelligence-driven components/circuitry, other entities, components and the like or the effort thereof.

Any component identified as a "plate" herein includes, but is not limited to, a plate as that term is commonly understood (e.g., a thin, flat sheet or strip of metal or other material), and may have non-planar surfaces or construction, may not be thin per se, may have any other form suitable for use in the particular configuration in which it is used (e.g., may be a curved or curvilinear-shaped member, housing, cone, sleeve, flange, collar, etc.), may be comprised of multiple parts or a combination thereof.

The terms "rigidly coupled" and variations thereof mean connected together in a manner that is intended not to allow any, or more than an insubstantial or minimal amount of, relative movement therebetween as is expected during typical or expected operations. In other words, if components A and B are rigidly coupled together, they are not movable relative to one another (more than a minimal or insubstantial amount) during typical or expected operations.

The terms "spring" and variations thereof mean and refer to one or more resilient members (e.g., compression or torsion springs, helical springs, radial wave springs, radial springs, coil springs, Bellville-washers, bow springs, banana springs, leaf springs, disc springs) and/or non-resilient members (e.g., sleeve, ring, pin, coupling, piston, a conductive ring biased with a banana or bow spring) capable of being biased against, and/or providing biasing forces upon, one or more other members or components. Accordingly, the "spring" may be a spring (in its literal sense) or any other component or combination of components configured to be biased by, or able to spring-bias, one or more other members or components. Moreover, when a component is described herein as "biased" or "spring-biased", the component is arranged to be forced or pressed in one or more directions by one or more springs and/or other mechanisms or forces (e.g., gas, liquid, power-driven, electronically driven), and in at least some cases can be moved back (in the opposite general direction) upon the application of force(s) to the component sufficient to overcome the pressing forces thereupon. Thus, biasing or spring biasing does not require the use of one or more actual springs to provide the biasing force(s) and, in fact, any desired or suitable mechanism or arrangement of parts may be used, except and only to the extent as may be expressly recited and explicitly required herein or in a particular claim hereof and only for such claim(s) and any claim(s) depending therefrom.

The terms "upright", "vertical", "vertically-oriented" and variations thereof refer to and include oriented perfectly vertical (at right angles to a horizontal plane), substantially vertically or sufficiently vertically to allow the normal, typical or expected operation thereof (e.g., when referring to a flare stack).

It should be noted that any of the above terms may be further explained, defined, expanded or limited below or in other parts of this disclosure. Further, the above list of terms is not all inclusive, and other terms may be defined or explained below or in other sections of this patent.

In various embodiments, the present disclosure includes system, apparats and methods for carrying, transporting, erecting, lowering and servicing a flare stack, associated igniter(s) or other components having one or more of the following features or capabilities, other features and capabilities mentioned elsewhere in this disclosure or shown in the appended drawings or which may be apparent therefrom: is easy to handle; eliminates the need for a telehandler to rig up the flare stack; provides for performing all operations by 1-2 operators with one vehicle; provides all necessary components mounted on a single skid in a position ready to easily and quickly be deployed and connected; eliminates the time-consuming process of transporting and rigging-up the flare stack with various equipment; allows the flare stack, igniter and related components to be transported, positioned, assembled, erected, connected, inspected, serviced, repaired and disassembled with one vehicle, 1-2 operators on the ground and no other equipment (except hand tools); requires fewer personnel (e.g., in some embodiments, no spotter or tag-line holder) on site to transport, erect and connect the flare stack and related components and no personnel at the flare stack during lifting or lowering thereof; involves delivering and erecting the flare stack without the need for tag lines, guide wires, T-stands or other components to mark or support the flare stack; does not require loading or transporting the flare pipe on a sling or lifting saddle or in a vertical or erect position; involves erecting, rigging up and lowering the flare pipe as desired in a secure manner on a stable platform without hands-on operator involvement; involves an automated, remotely controllable flare stack lifting and lowering device; moves the flare stack in a linear path in a single plane forward in a laying-down motion and rearward in a standing-up motion; involves pivotably raising and lowering the flare stack; involves moving the flare stack rearwards and upwards at an approximate 45 degree lift angle around two pivot points to a vertical position; involves erecting the flare stack with a sliding or moving, lever or tilting action; involves erecting the flare stack by moving the flare stack from a generally horizontal or angled position to a generally vertical operating position; involves, from a generally horizontal or slightly angled orientation of the flare stack, sliding the lower end of the flare stack generally horizontally while tilting the upper end of the flare stack upwardly into an erect position; involves a mobile flare stack transporter that is easily transported via forklift, telehandler, skid-steer or the like to and from each job site with the flare stack in a non-vertical, lowered, stable position and ready for automated erection; involves a skid-mounted flare stack transporter that carries the flare stack and all related components for transport to and from each job site with automated erection of the flare stack at a total weight of 5,000 lbs. or less; involves a skid-mounted flare stack transporter having a pipe connection (e.g., PUP joint) rigidly coupled thereto or integral therewith that can be bolted in-line with the flare pipe coming off the drilling rig prior to standing up the flare stack to help stabilize and anchor the transporter before erecting the flare stack; involves (i) delivering a flare stack transport skid to the desired job site with no pipe components dangling overhead, (ii) connecting the skid to the flare pipe coming off the drilling rig (or other component(s)) to stabilize, secure or anchor the skid before remotely erecting the flare stack and (iii) manually coupling one or more flare pipe sections carried on the skid between the flare stack and flare pipe coming off the drilling rig (or other component(s)); provides a convenient, easily accessible lowered position for the flare stack where it can be easily accessed for inspection, service, etc.; provides multiple flaring height options with one or more flare pipes and ignition stack extensions stowed on board the flare stack transporter so that the flare stack height can be easily and quickly varied; involves a flare stack igniter that is separate from the flare stack; does not require operators working on the flare stack igniter to inspect, service or repair it when it is up in the air; involves an igniter mounted on an igniter boom that is moveable up and down relative to the flare stack; involves a flare stack igniter that can be lowered, inspected, serviced, replaced etc. with operators on the ground and while the flare stack and/or drilling rig are operating; involves a flare stack igniter that can be mechanically lowered to the ground while the flare stack and/or drilling rig are operating; or a combination thereof.

In some embodiments, for example, a winch truck, skid steer, forklift or similar mover may be used to carry and drop off the flare stack transporter at the job site, such as at the end of the flare pipe coming off a drilling rig (or other component(s)). The transporter may have a pipe connection (e.g., PUP joint) mounted thereon which can be coupled to the flare pipe coming off the drilling rig (or other components). If the height of the flare stack needs to be increased, a skid steer or similar transporter can be used to move one or more flare stack extensions (e.g., stored on the transporter) to the upper end of the lowered flare stack for coupling thereto. One or more ignition boom extensions (e.g., stored on the transporter) can be (e.g., manually) coupled to the upper end of the ignition boom. A retractor (e.g., winch) can be remotely actuated to raise the flare stack (and ignition boom with it) into an operating position. One or more anchors can be secured between the transporter and flare stack. One or more flare pipe sections can be unsecured from a stowed position on the transporter and manually or automatically rolled (e.g., just inches) into position between the lower end of the flare stack and the pipe connection (or drilling rig flare pipe). The flare pipe section(s) can then be (e.g., manually) coupled to the flare stack and pipe connection. Thereafter, the process can be reversed to break down the components and secure them to the transporter, which can be moved to the next location. However, the above is not required for every embodiment and, thus, the present disclose neither requires nor is limited to the above details.

Figure 2:
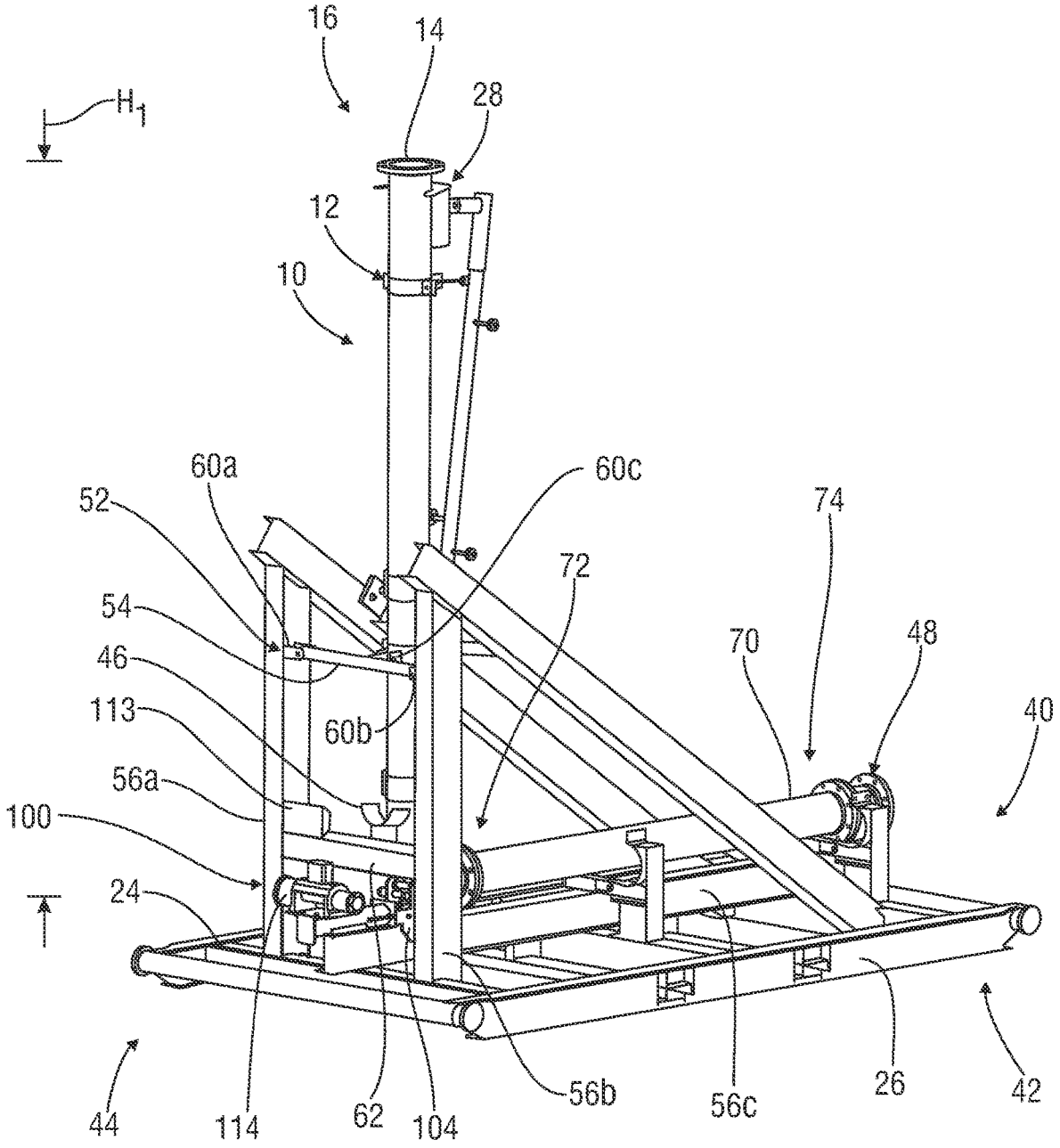
FIG. 2 is a perspective view of the exemplary flare stack transporter of FIG. 1 showing the flare stack in an exemplary upright operating position and having an exemplary (generally) horizontally-oriented flare pipe section coupled to its lower end in accordance with one or more embodiments of the present disclosure.

Referring initially to FIGS. 1 & 2, an exemplary flare stack 10 is shown associated with an exemplary flare stack transporter 40 in accordance with the present disclosure. The flare stack transporter 40 may have any desired purpose(s), such as to carry the flare stack 10, allow it to be raised, operated, lowered, serviced, stored, transported or a combination thereof. The flare stack 10 may have any suitable form, configuration, components and operation. For example, the flare stack 10 may be composed of one or multiple flare stack segments (e.g., conventional 8" oilfield pipe segments coupled together with pipe connectors) to allow ease of assembly, disassembly or maintenance, flexibility in sizing the length, height and angle of the flare stack 10, for any other desired purpose(s) or a combination thereof. Various components may be coupled to the exemplary flare stack 10 (or other components) with one or more saddle brackets 12, such as to provide a reliable, rigid connection (when desired), allow easy disassembly, for any other purpose(s) or a combination thereof. However, the present disclosure is not limited to the use of saddle brackets 12, and, in some embodiments, may not be included or any other types of brackets, connectors, couplings or other component(s) may be used to accomplish the desired result.

Still referring to FIGS. 1 & 2, the exemplary flare stack 10 is configured to be extendable up to a desired operating position, such as at height H1 (e.g., 15'), and includes at least one ignition feed outlet 20 (e.g., FIG. 4) proximate to its upper end 16 (or any other location(s)) and which is useful to provide a stream of gas to one or more flare stack igniters 28 associated therewith. The illustrated flare stack 10 also has at least one flange, or pipe coupling, 14 at or proximate to its upper and lower ends 16, 18, respectively, for releasably coupling the flare stack 10 to one or more flare stack extensions 30 (e.g., FIG. 4) or other component(s) at or proximate to its upper end 16 and one or more flare pipe sections 70 or other component(s) at or proximate to its lower end 18. However, in other embodiments, the flare stack 10 may have only some or none of the above components and/or capabilities and may include different or additional components and/or capabilities.

Figure 3:
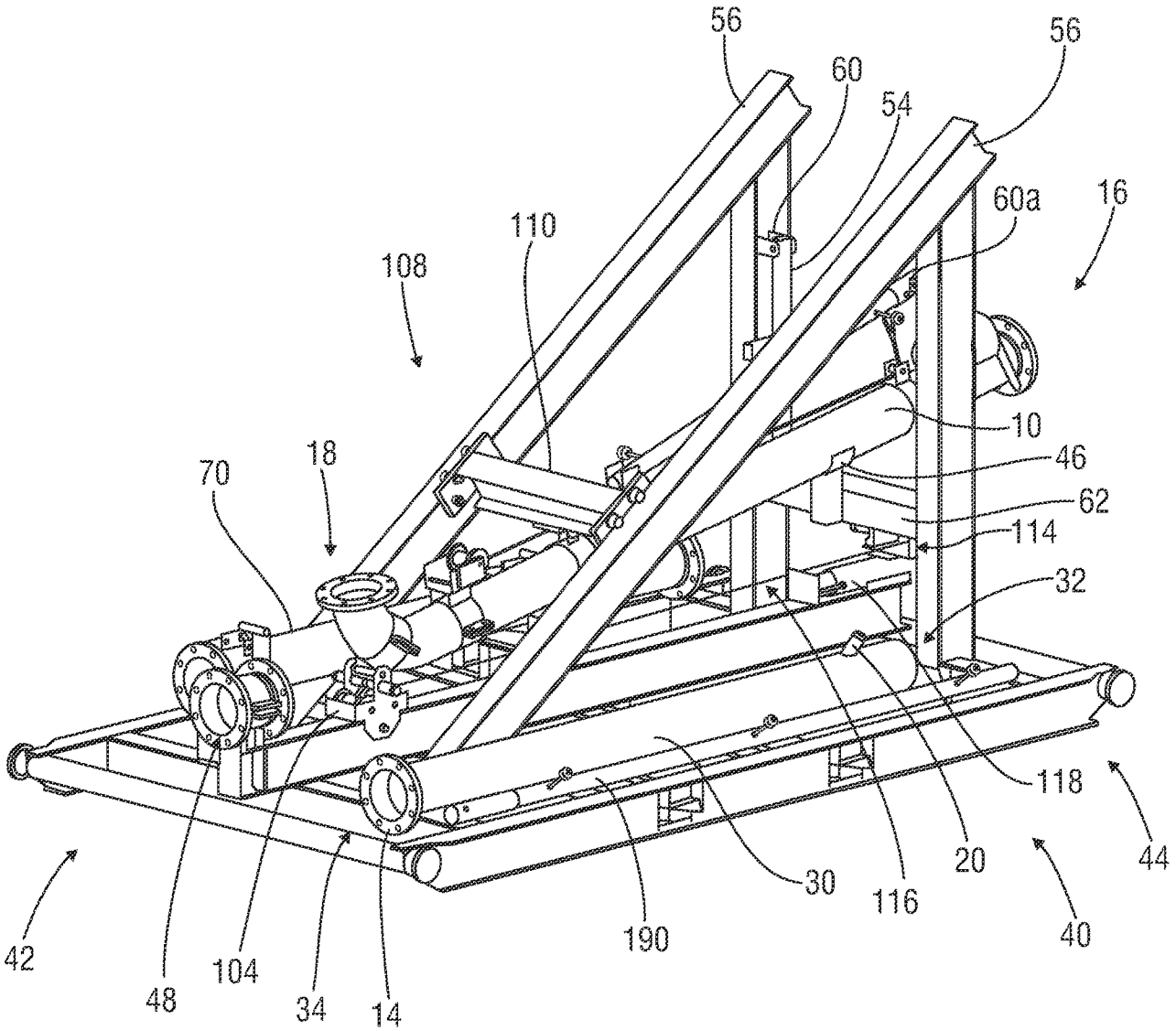
FIG. 3 is another perspective view of the exemplary flare stack transporter and components thereon of FIG. 1.
Figure 4:
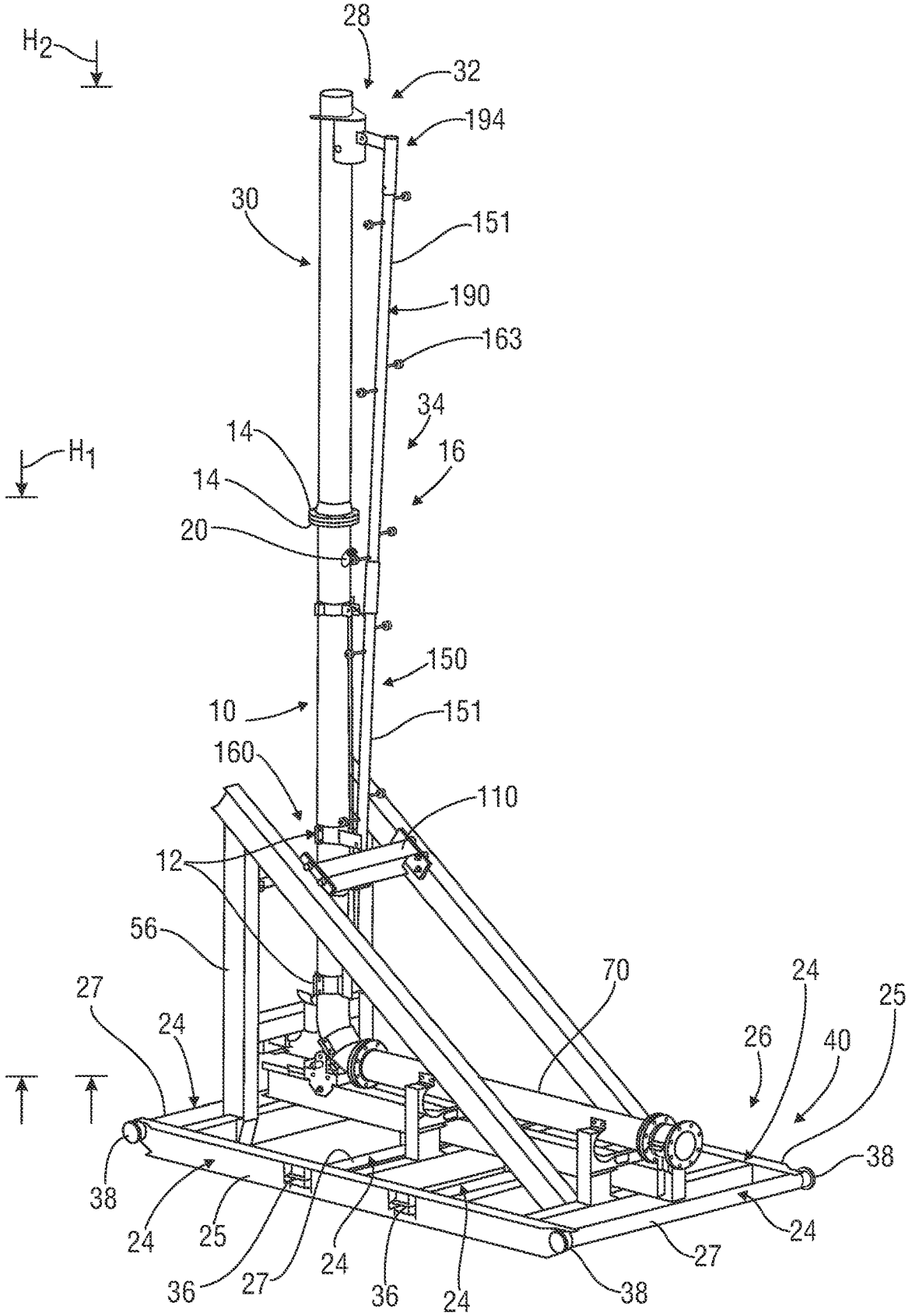
FIG. 4 is a perspective view of the exemplary flare stack transporter of FIG. 2 showing the flare stack having an exemplary flare stack extension coupled to its upper end in accordance with one or more embodiments of the present disclosure.

Referring briefly to FIGS. 3 & 4, when included, the flare stack extension(s) 30 may have any suitable form, configuration, components and operation. For example, the flare stack extension 30 may include one or more ignition feed outlets 20 proximate to its upper end 32 (or at any other desired location) so that gas exhausted through the flare stack 10 may be ignited as it exits the flare stack 10 and extension(s) 30. The illustrated flare stack extension 30 also includes at least one flange, or pipe coupling, 14, such as at or proximate to lower end 34, for releasably coupling the flare stack extension 30 to the flare stack 10, for any other purpose(s) or a combination thereof. In the present embodiment, the flare stack extension 30 may be coupled to the flare stack 10 without the need for any lifting equipment or tools.

If desired, one or more flare stack extensions 30 may be stowed or stored on the exemplary flare stack transporter 40 when the extension 30 is not in use (e.g., FIG. 3), such as for easy and quick access thereto, to optimize the use of space and/or distribution of weight on the transporter 40, to allow unimpeded movement of the flare stack 10 between operating and stowed or lowered positions, for any other purpose(s) or a combination thereof. For example, the flare stack extension 30 may be held on or in the transporter 40 in or with one or more brackets, clamps, bolts, clips, etc., a combination thereof or in any other manner.

Likewise, the flare pipe section(s) 70 may have any suitable form, configuration, components and operation. Referring back to FIGS. 1 & 2, for example, the flare pipe section 70 may, in some instances, be conventional 8" oilfield pipe for coupling the flare stack 10 to the drilling rig (or other component(s) or sources of gas) and include one or more flanges, or pipe couplings, 14. In this embodiment, the flare pipe section 70 is generally horizontally-oriented and includes a flange, or pipe coupling, 14 at or proximate to its upper end 72, such as for releasable connection to the lower end 18 of the flare stack 10, and a flange, or pipe coupling, 14 at or proximate to its lower end 74 for releasable connection to the drilling rig (not shown) or other system or component(s).

Still referring to FIGS. 1 & 2, if desired, the flare pipe section(s) 70 may be carried on the flare stack transporter 40 during its use and/or when not in use and/or moveable between at least one stowed and at least one operating position. This may be desirable for ease and speed of access to, handling, storage, transport, connection or use of the flare pipe section 70, for proper positioning of components, to allow unimpeded movement of the flare stack 10 between operating and lowered (stowed) positions, for any other purpose(s) or a combination thereof. For example, the flare stack transporter 40 may include one or more cradles 78 to hold and/or secure the position of the flare pipe section(s) 70. In the present embodiment, two cradles 78 for holding the flare pipe section 70 are rigidly coupled to the transporter 40. However, any desired number (e.g., one or more than two) of rigidly or non-rigidly coupled cradles 78 or other components for holding or carrying one or more flare pipe sections 70 on the transporter 40 may be used.

Figure 8:
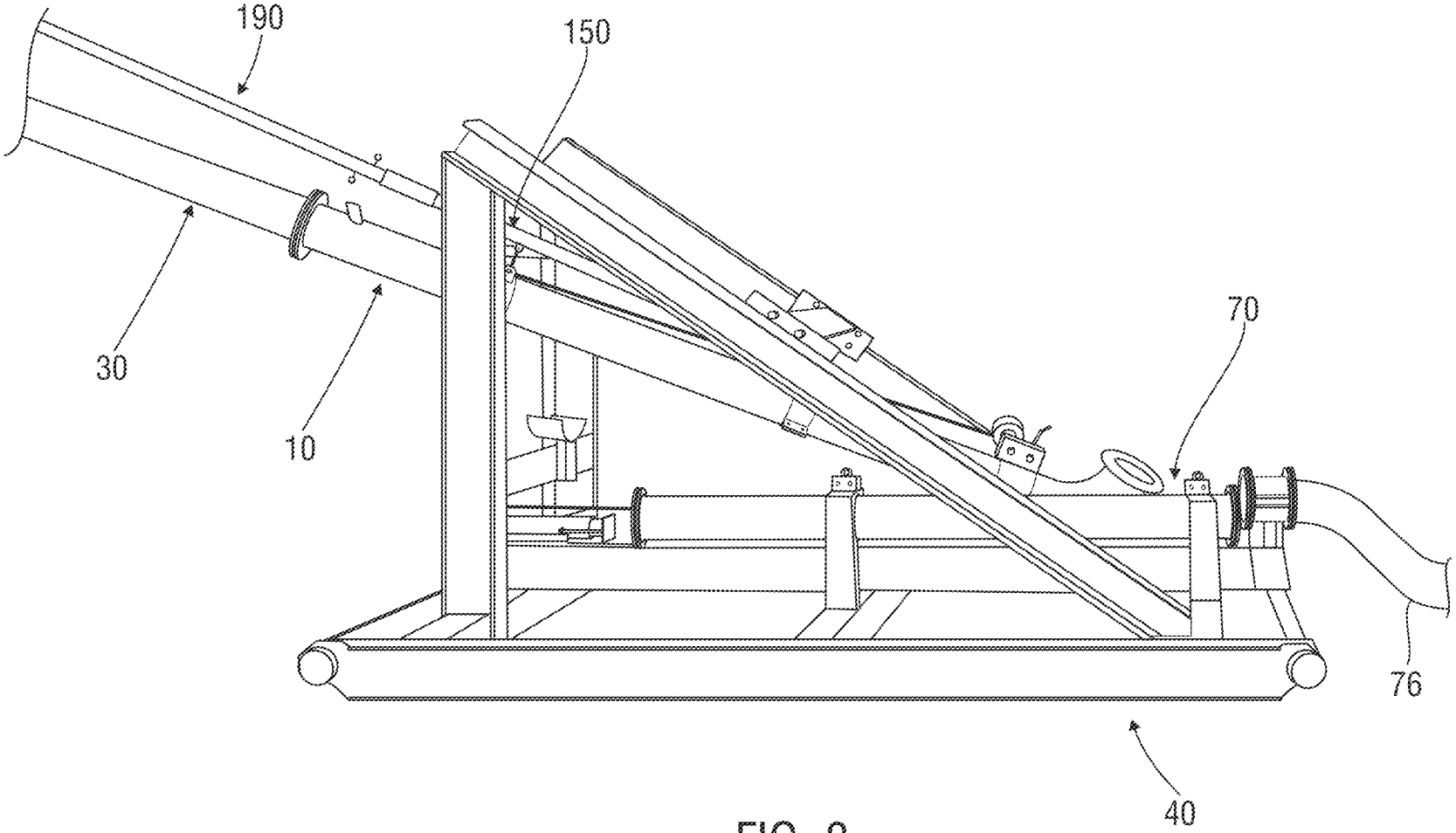
FIG. 8 is a perspective view of the exemplary flare stack transporter of FIG. 4 showing the flare stack and flare stack extension in a lowered position in accordance with one or more embodiments of the present disclosure.

When included, the cradle(s) 78 may have any suitable capabilities and operation. In the present embodiment, at least one cradle 78 provides both stowed (e.g., FIG. 1) and operating (e.g., FIG. 2) positions for the flare pipe section 70 on the transporter 40. For example, each cradle 78 may be movable between at least one "flare pipe stowed" position (e.g., FIG. 1) during non-use of the flare pipe section 70 and transport and storage of the flare pipe transporter 40, and at least one "flare pipe operating" position (e.g., FIG. 2) to allow the flare pipe section 70 to move between stowed and operating positions. In the flare pipe stowed position, if desired, the exemplary flare pipe section 70 may be secured to the transporter 40 near its operating position (e.g., for convenience, quick and easy access, etc.). In the exemplary flare pipe operating position, the illustrated flare pipe section 70 is aligned with the flare stack 10 and drilling rig flare pipe 76 (e.g., FIG. 8) or other gas source (e.g., via pipe connector 48, such as discussed below) for proper positioning thereof and quick and easy connection therewith.

Figure 5:
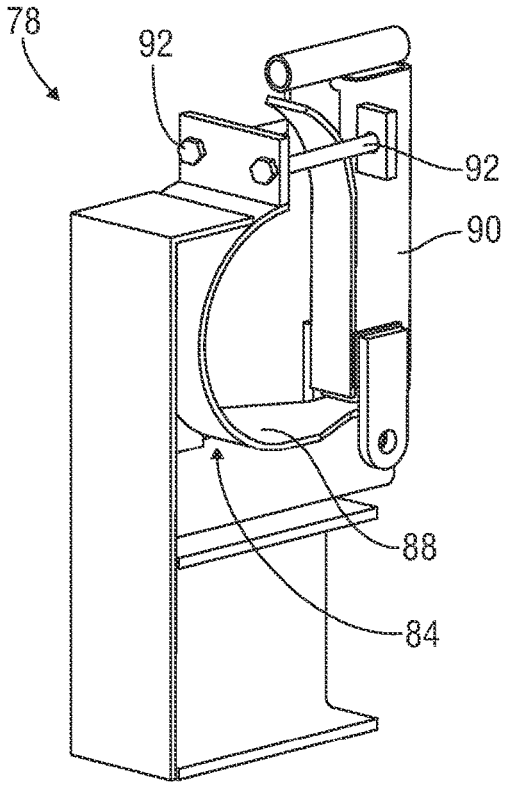
FIG. 5 is a perspective view of one of the exemplary cradles of FIG. 1 in accordance with one or more embodiments of the present disclosure.
Figure 6:
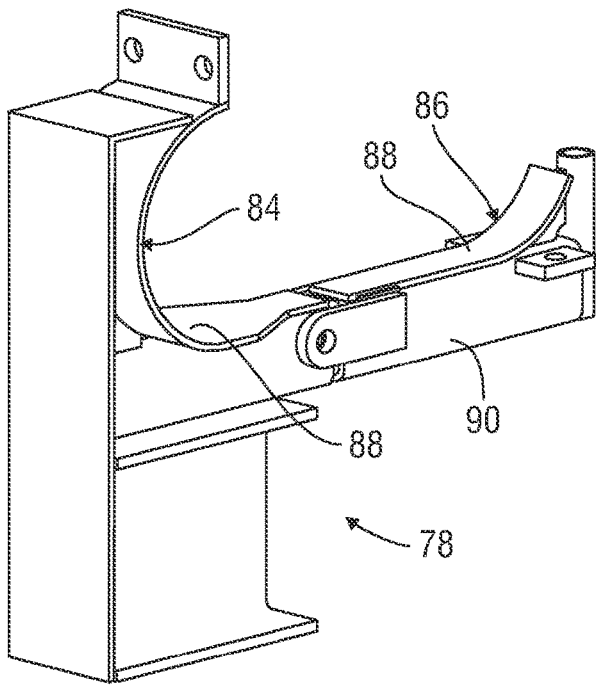
FIG. 6 is a perspective view of the exemplary cradle of FIG. 5 in an exemplary "flare pipe operating" position in accordance with one or more embodiments of the present disclosure.

Referring to FIGS. 5 & 6, FIG. 5 shows a close-up of a flare pipe stowed position of the exemplary cradle 78 and FIG. 6 shows a close-up of an exemplary flare pipe operating position of the cradle 78. The cradle(s) 78, when included, may have any suitable form, configuration, components and operation. In this embodiment, the cradle 78 includes a first pipe seat 84 in which the flare pipe section 70 can reside during storage, transport, etc. (e.g., FIG. 1) and a second pipe seat 86 where the flare pipe section 70 can reside during use and operation thereof (e.g., FIG. 2). Each illustrated pipe seat 84, 86 includes at least one curved section 88 to help retain the flare pipe section 70 in the desired position.

Figure 7:
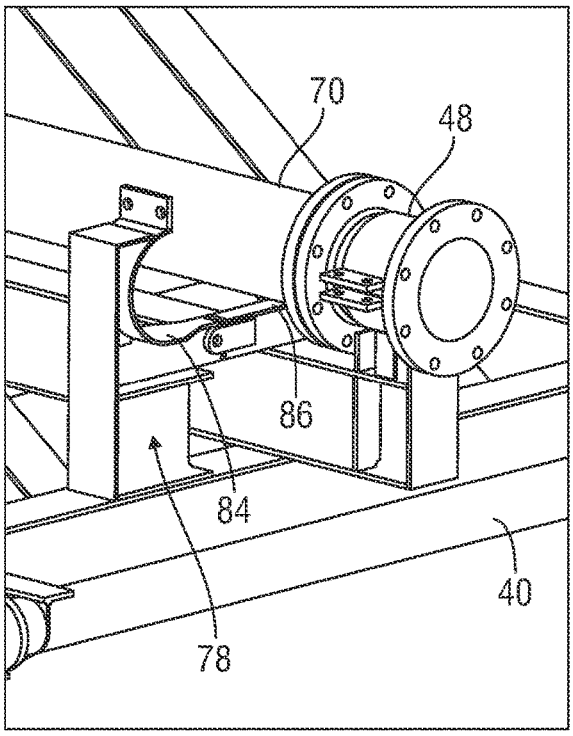
FIG. 7 is an exploded perspective view of part of front end of the flare stack transporter of FIG. 2 showing the horizontally-oriented flare pipe section seated in a second pipe seat of the illustrated cradle in accordance with one or more embodiments of the present disclosure.

The exemplary cradle 78 also includes one or more selectively movable arms 90 to allow the flare pipe section 70 to be moved between the first and second pipe seats 84, 86 and/or for any other purpose(s). The illustrated arm 90 is pivotable (or otherwise movable) between one or more stowed (e.g., closed) positions (e.g., FIG. 5) to help retain the flare pipe section 70 in the first pipe seat 84 (e.g., FIG. 1), and one or more operating (e.g., open) positions (e.g., FIG. 6) to help retain the flare pipe section 70 in the second pipe seat 86 (e.g., FIG. 7). If desired or necessary, one or more releasable locks 92 (e.g., bolts, pins, clips, etc.) may be used to secure the arm 90 (and flare pipe section 70) in a stowed position (e.g., FIG. 5). In use of the exemplary cradle 78, once the lock(s) 92, if included, are removed and the arm 90 is moved to an open position (e.g., by hand without any tools or automated), the flare pipe section 70 may simply be rolled to an operating position (e.g., pushed by one operator without any tools) where it is automatically aligned with the flare stack 10 and pipe connector 48 (or flare pipe coming from the drilling rig or other components) and can be bolted thereto without any equipment. The exemplary flare pipe section 70 may thereafter be pushed or rolled back to a stowed position, the arm 90 moved to a stowed position and so on.

In some embodiments, the opening and closing of the cradle 78 may be automated or remotely controlled. In various embodiments, the cradle 78 may be configured (e.g., with a downwardly sloping surface) so that the opening or movement of the arm 90 (or other component) allows the flare pipe section 70 to automatically move (e.g., roll) into the operating position without any operator involvement. However, other embodiments of the cradle 78 may have additional or different components, features and operation. Moreover, any other components and techniques may be used to carry one or more flare pipe sections 70 on the transporter 40 in one or more positions and/or move it or them between positions.

Figure 9:
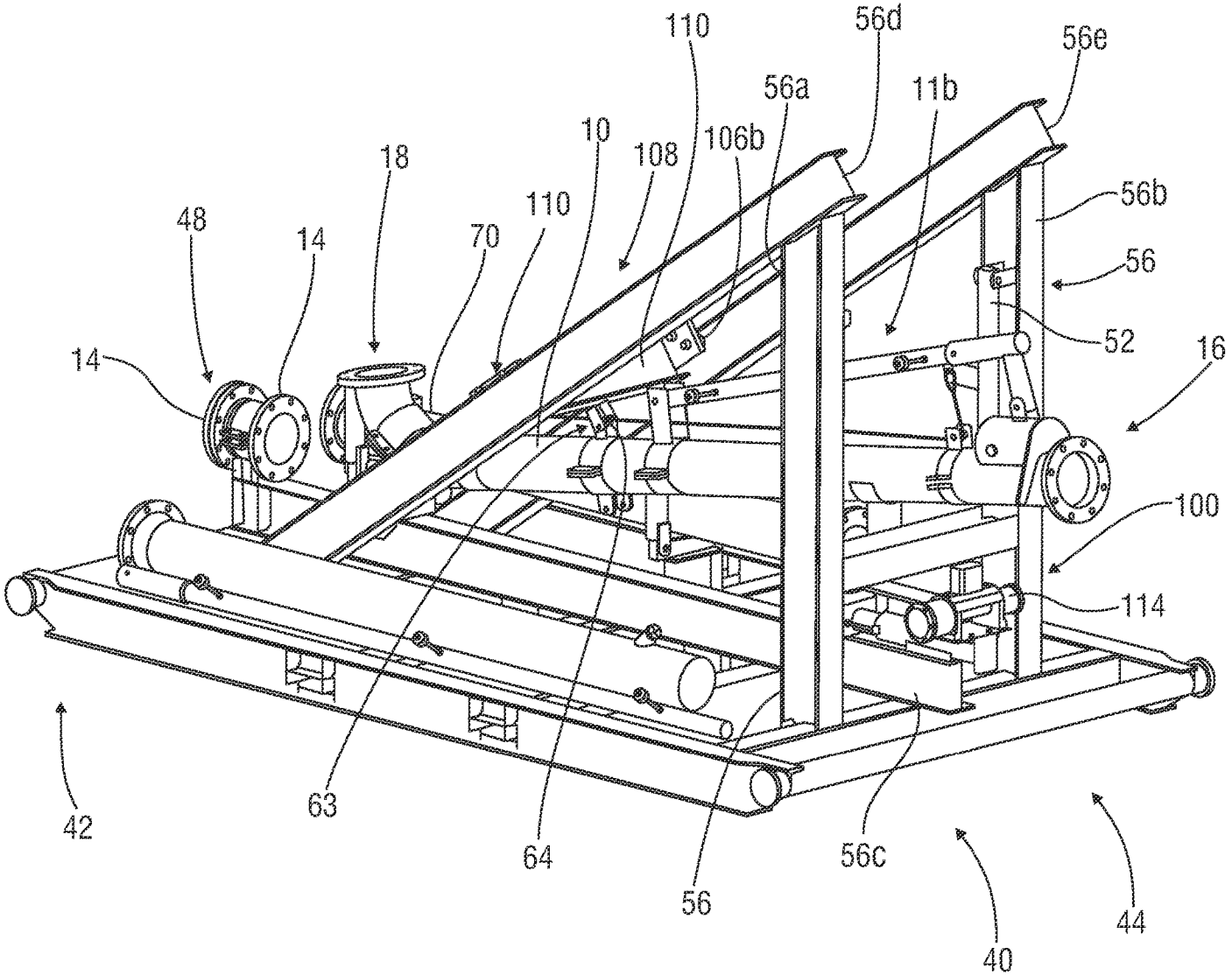
FIG. 9 is a perspective view of the exemplary flare stack transporter and components thereon of FIG. 1 in accordance with one or more embodiments of the present disclosure.

Referring now to FIGS. 2 & 9, if desired, the flare stack transporter 40 may include one or more pipe connectors 48 (e.g., PUP joint) for releasably connecting the transporter 40, flare pipe section 70 and/or flare stack 10 to the flare pipe 76 (e.g., FIG. 8) coming off the drilling rig (or other component(s)). Connecting the transporter 40 to the drilling rig flare pipe 76 or other component(s) may be useful, for example, to help secure, anchor and/or stabilize the transporter 40 in its desired position before raising the flare stack 10 and during operation thereof and/or for any other purposes. Connecting the flare pipe section 70 to the drilling rig flare pipe 76 (or other components) may be useful, for example, to assist in ease and speed of assembly and rig up of the various pipe components (flare stack 10, flare pipe section 70, drilling rig flare pipe 76, etc.) and/or for any other purpose(s).

When included, the pipe connector(s) 48 may have any suitable form, configuration and operation. In this embodiment, the pipe connector, or PUP joint, 48 is a short piece of (e.g., 8") pipe having at least two flanges, or pipe couplings, 14 useful for the releasable connections described above. The exemplary pipe connector 48 is rigidly coupled to the transporter 40 (e.g., welded, bolted, etc. to the third support 56*c*), or integral therewith, at or proximate to the front end 42 thereof and in line with the lower end 18 of the flare stack 10. Thus, when the exemplary flare stack 10 is in an operating position and the upper end 72 of the flare pipe section 70 is aligned with and/or coupled to the flare stack 10, the lower end 74 of the flare pipe section 70 will be aligned with the pipe connector 48 for connection to the drilling rig (or other system or components). However, the pipe connector 48 may not be rigidly connected to the transporter 40 or included, and additional, other or no components and/or techniques may be used to help anchor the transporter 40 and connect the flare pipe section 70 with the drilling rig (or other components).

Figure 29:
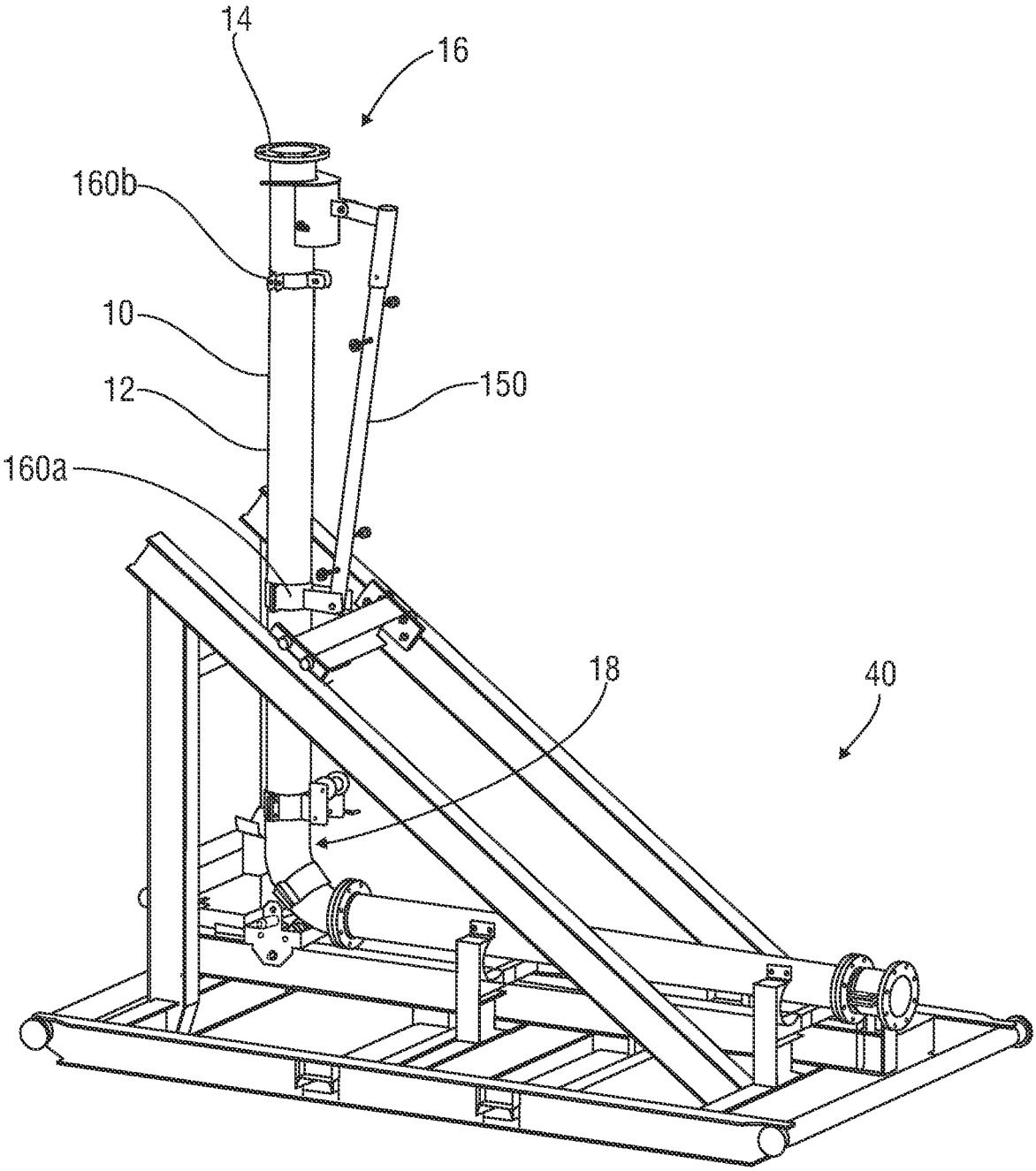
FIG. 29 is a perspective view of the exemplary flare stack transporter of FIG. 2 in accordance with one or more embodiments of the present disclosure.
Figure 30:
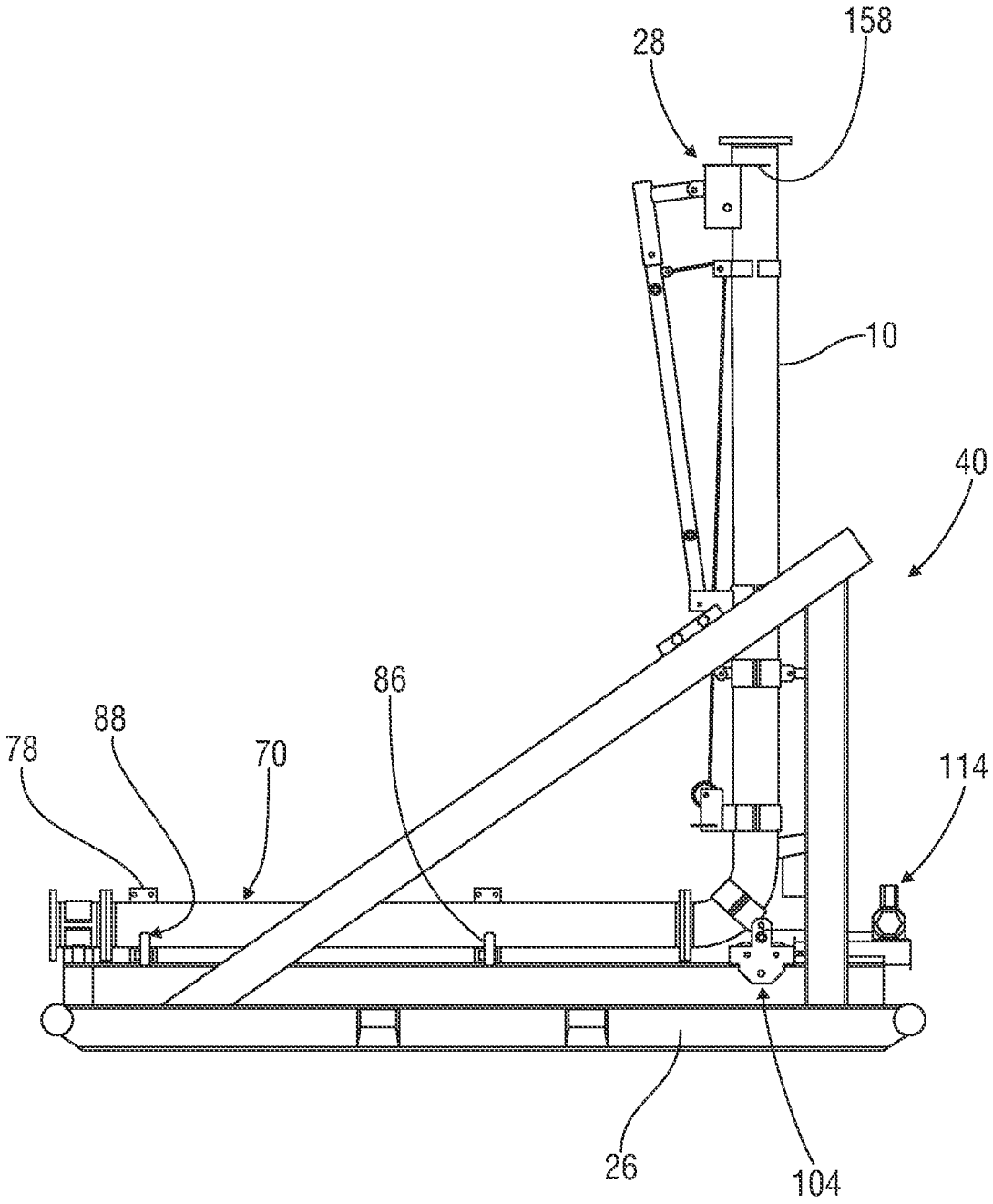
FIG. 30 is a side view of the exemplary flare stack transporter of FIG. 2 in accordance with one or more embodiments of the present disclosure.
Figure 31:
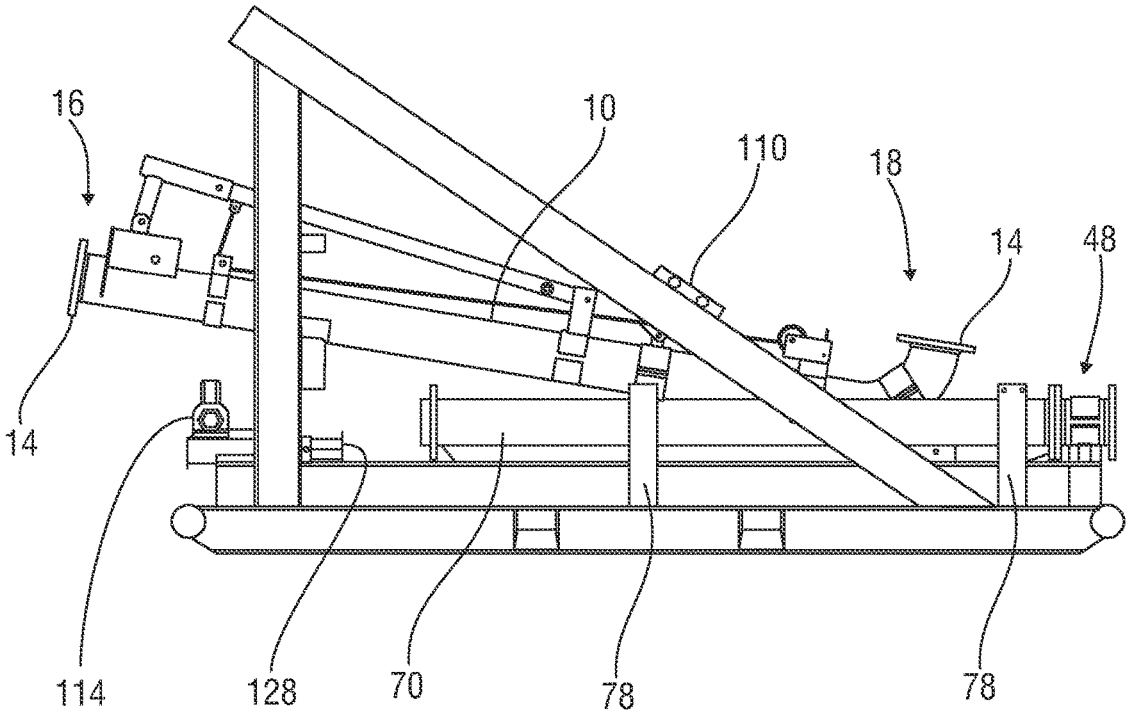
FIG. 31 is a side view of the exemplary flare stack transporter of FIG. 1 in accordance with one or more embodiments of the present disclosure.

Referring back to FIGS. 1 & 2, the flare stack 10 may be associated with the flare stack transporter 40 in any suitable manner. In the present embodiment, the flare stack 10 is selectively moveable on the flare stack transporter 40 between at least one lowered (or stowed) position (e.g., FIGS. 1, 31-33) and at least one operating position (e.g., FIGS. 2, 29-30). As used herein, the terms "operating position" and variations thereof, when referring to the flare stack, mean and refer to one or more at least partially raised, erect, vertical orientations in which the flare stack is designed to flare-off gas from the drilling rig(s) or other source(s). The exact orientation of the flare stack 10 in an operating position may vary depending upon various variables and my thus not be perfectly vertical. The terms "lowered position" and variations thereof, when referring to the flare stack 10, may typically be one or more orientations of the flare stack 10 in which the upper end 16 of the flare stack 10 is at height lower than its height when in an operating position(s), which may, for example, be horizontally or angularly oriented. Depending upon the embodiments, the lowered position may be a position in which the flare stack 10 is stowed, may be transported, serviced, etc.

Any suitable components and techniques may be used to position, hold or secure the flare stack 10 in transport and/or operating positions. For example, the flare stack transporter 40 may include at least one pipe saddle 46 within which the flare stack 10 may rest or be secured in at least one lowered position. In this embodiment, a single open, fixed-position, pipe saddle 46 is provided on the flare stack transporter 40 near the rear end 44 thereof to hold or seat the flare stack 10 (e.g., proximate to its upper end 16) in a lowered position. If desired, one or more securing, or locking, members (not shown) may be associated with the pipe saddle 46 to assist in securing or holding the flare stack 10 therein, such as one or more removeable bolts, pins, clips, bands or the like. However, any desired number of open, closed, fixed, movable or other types of pipe saddles 46 or other components may be used at any desired locations on the flare stack transporter 40 to hold, carry or secure the flare stack 10 in one or more lowered or other positions.

Referring now to FIG. 3, in a lowered position, the exemplary flare stack 10 is fully accessible and may be easily repaired, reconfigured or otherwise worked on, stowed and transported. For example, if it desired to increase or decrease the height of the flare stack 10, the height of the illustrated flare stack 10 may be adjusted while in a lowered position. In the present embodiment, while the flare stack 10 is in a lowered (or any other) position, one or more flare stack extensions 30 may be coupled to the upper end 16 (or other desired location) of the flare stack 10 to increase its height to a desired height H2 (e.g., FIG. 4) or disengaged from the flare stack 10 (e.g., to decrease its height, configure it for transport or storage, etc.). However, any other, different or no activities may be performed with the flare stack 10 in a lowered position and the flare stack extension(s) 30 can be added/removed to the flare stack 10 in any other desired position of the flare stack 10. Moreover, any other components and techniques may be used to increase or decrease the height of the flare stack 10 (in any position). For example, the flare stack 10 may have one or more telescoping members or portions (not shown) to allow its height to be selectively increased or decreased as desired.

Referring back to FIG. 2, the exemplary flare stack 10 may be secured in one or more operating positions in any suitable manner. In this embodiment, at least one anchor 52 may be used to assist in securing the flare stack 10 in one or more operating positions. The anchor 52 may have any suitable form, configuration, components and operation. For example, the anchor 52 may include one or more braces 54 releasably engageable between the flare stack 10 and flare stack transporter 40. In this embodiment, the brace 54 is configured to releasably couple the flare stack 10 to one or more supports 56 on the transporter 40. The supports 56 may have any suitable form, configuration, location and operation. In this embodiment, the supports 56 are steel I-beams rigidly secured (e.g., via weld) to the one or more base members 24 (e.g., cross-beams 27) of the base, or skid, 26 of the transporter 40, but could take any other form. For example, the supports 56 may be integral to the transporter 40 and may not be I-beams.

Figure 10:
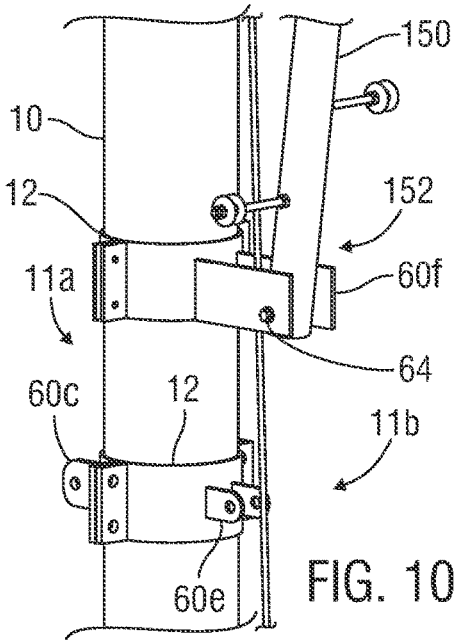
FIG. 10 is a perspective view of part of the exemplary flare stack of FIG. 2 in accordance with one or more embodiments of the present disclosure.

Still referring to FIG. 2, the illustrated brace 54 has a generally T-shape, is movably (e.g., pivotably) coupled to a first support 56*a* and moveable from a stowed position (e.g., FIG. 8) into releasable engagement (e.g., via bolt, pin, clip, etc.) with a second support 56*b* and the flare stack 10 to secure the flare stack 10 in an operating position. The exemplary brace 54 engages respective receiving brackets 60 (e.g., brackets 60*a-c*) extending from and rigidly secured to, or integral with, the first and second supports 56*a*, 56*b* and the flare stack 10 (see also FIG. 10). However, the brace 54 or other form of anchor 52 may have any other configuration, components and operation, or the flare stack 10 may be retained in one or more operating positions in any other suitable manner. Additionally, the anchor 52 or other mechanisms for securing the flare stack 10 in an operating position may be actuated automatically and/or remotely, such as to avoid, reduce or minimize the necessity of operators on site in securing and releasing the flare stack 10 into/from an operating position.

If desired, the supports 56*a*, 56*b*, anchor(s) 52 and related components may be positioned and configured for proper positioning of components, to allow unimpeded movement of the flare stack 10 between operating and lowered positions, for easy and quick access thereto, to optimize the use of space and/or distribution of weight on the transporter 40, for any other purpose(s) or a combination thereof. In this embodiment, the first and second supports 56*a*, 56*b* (e.g., I-beams) extend at least substantially vertically (or, if desired, angularly) upwardly in spaced-relationship with one another proximate to the rear end 44 of the transporter 40. The exemplary flare stack 10 is shown forward of and (along with the exemplary pipe saddle 46) straddled between the first and second supports 56*a*, 56*b* so that, when the illustrated anchor 52 is in a stowed position (e.g., FIG. 9), the flare stack 10 may be movable between positions and seated, worked on and transported in the pipe saddle 46.

Still referring to FIG. 2, one or more stabilizers 62 may be provided on the transporter 40 to assist in ensuring stabilization of the flare stack 10 and transporter 40 during use and/or for any other purposes. When included, the stabilizer(s) 62 may have any suitable form, configuration and location. In this embodiment, a first stabilizer 62 (e.g., I-beam) is engaged between the first and second supports 56*a*, 56*b* to help ensure the stability of the supports 56*a*, 56*b* and help maintain and stabilize the flare stack 10. If desired, the first stabilizer 62 may carry or include the pipe saddle 46 (e.g., FIG. 3).

Figure 28:
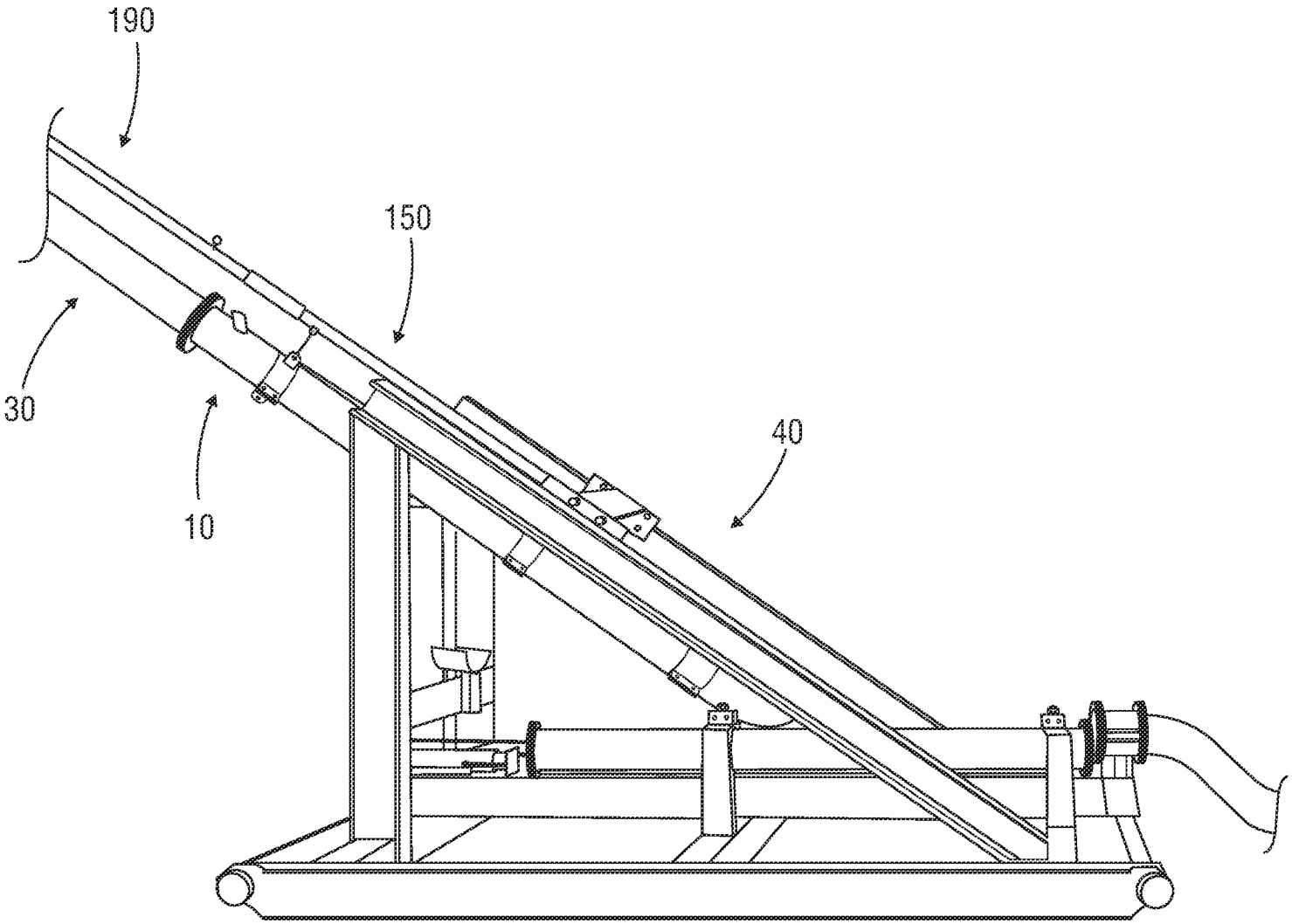
FIG. 28 is a perspective view of the exemplary flare stack transporter and components thereon of FIG. 4 showing the flare stack and flare stack extension in a partially lowered position in accordance with one or more embodiments of the present disclosure.

Referring back to FIGS. 1 & 2, the exemplary flare stack 10 may be movable between transport and operating positions (when this capability is included) in any suitable manner. For example, flare stack 10 may be movable up and down substantially in a single plane or linear path, such as to maintain the stability, and prevent imbalance or wobbling, of the flare stack 10 and transporter 40 and/or for any other purposes. In the present embodiment, the flare stack 10 is movable from a lowered position generally rearward & up (e.g., FIG. 28) on, or relative to, the transporter 40 into a standing up motion into one or more operating positions. From an operating position, the exemplary flare stack 10 is moveable in the opposite direction, or forward & down on, or relative to, the transporter 40 into a laying down motion into one or more lowered positions. As used herein, the terms "forward" and variations thereof generally mean toward, or in the direction of, the front end 42 of the transporter 40 and the terms "rearward" and variations thereof generally mean toward, or in the direction of, the rear end 44 of the transporter 40. In this embodiment, the action of the flare stack 10 can be described as tilting, or a sliding or moving lever action. However, in other embodiments, the flare stack 10 may be movable in any other manner (e.g., in the opposite directions as described above).

Still referring to FIGS. 1 & 2, any suitable components and techniques may be used to move the flare stack 10 as desired. In some embodiments, one or more (e.g., automated, remotely controllable) flare stack erectors 100 may be used to help selectively move the flare stack 10 between positions on the flare stack transporter 40. The flare stack erector 100 may have any suitable form, configuration, components and operation. For example, the flare stack erector 100 may include at least one retractor 114 (e.g., automated winch), mounted on the transporter 40 (e.g., at or proximate to the rear end 44 thereof, FIG. 14) or otherwise associated therewith.

The exemplary retractor 114 may be selectively actuated to assist in drawing the flare stack 10 (e.g., back and up) from a lowered position to an operating position and allowing the flare stack 10 to move (e.g., forward and down) from an operating position into a lowered position.

The retractor 114 may be powered in any suitable manner, such as by one or more power sources 113 (e.g., battery, solar panel) mounted on the transporter 40 or associated therewith or in any other manner. Likewise, the retractor 114 (or other flare stack erectors 100) may be remotely controlled (e.g., via remote electronic or wireless controller, software, etc.), so that the flare stack 10 may be raised and/or lowered without any operators at or near the transporter 40 and/or for any other purposes. However, the retractor 114 or other flare stack erector(s) 100 may have any other form, components, configuration and operation. For example, the erector 100 (e.g., retractor 114) may include one or more hydraulic or pneumatic pistons, electric or non-electric motors, electronic controllers or devices (e.g., PLCs, encoders, sensors, cameras, lasers, robotics, etc.), any other form of manipulating device, other electrical and/or mechanical components, or any combination thereof.

Now referring to FIG. 3, the retractor 114 may be coupled to or associated with the flare stack 10 in any suitable manner. For example, the retractor 114 may be coupled to the lower end 18 of the flare stack 10 to selectively draw it rearward on the transporter 40 and draw it or allow it to move in the forward direction, when desired. In the present embodiment, the retractor 114 is coupled to at least a first roller guide, or trolly, 104 disposed at, or proximate to, the lower end 18 of the flare stack 10, such as with one or more cables, or lines, 116 and/or other component(s) (e.g., retractable rod(s)). The first trolly 104 may have any suitable form, configuration, components and operation. The exemplary first trolly 104 is associated with the flare stack 10 proximate to its lower end 18 and useful to assist in moving the lower end 18 back and forth at least partially between the front and rear ends 42, 44 of the transporter 40.

Figure 11:
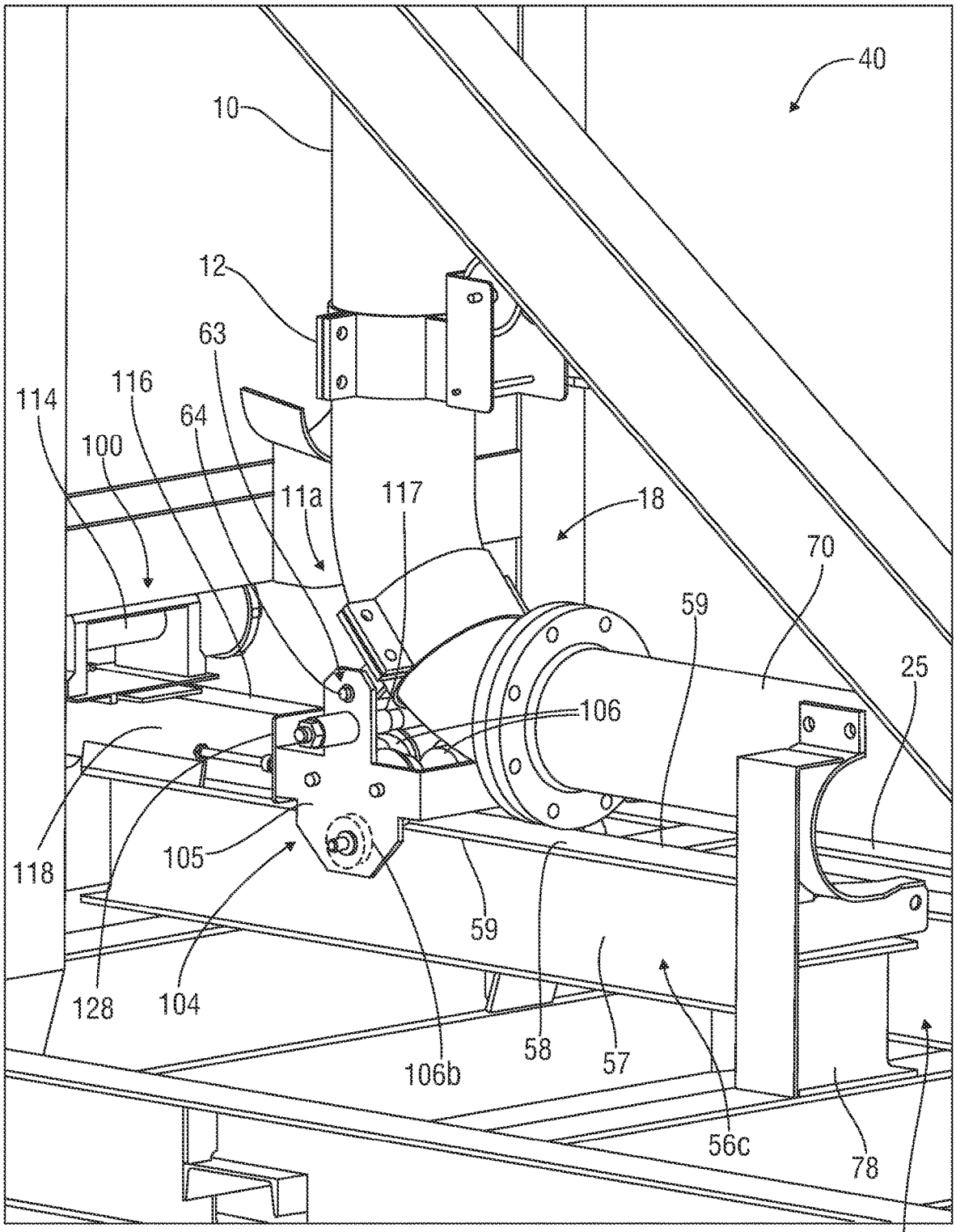
FIG. 11 is a perspective view of another part of the exemplary flare stack of FIG. 2 in accordance with one or more embodiments of the present disclosure.
Figure 12:
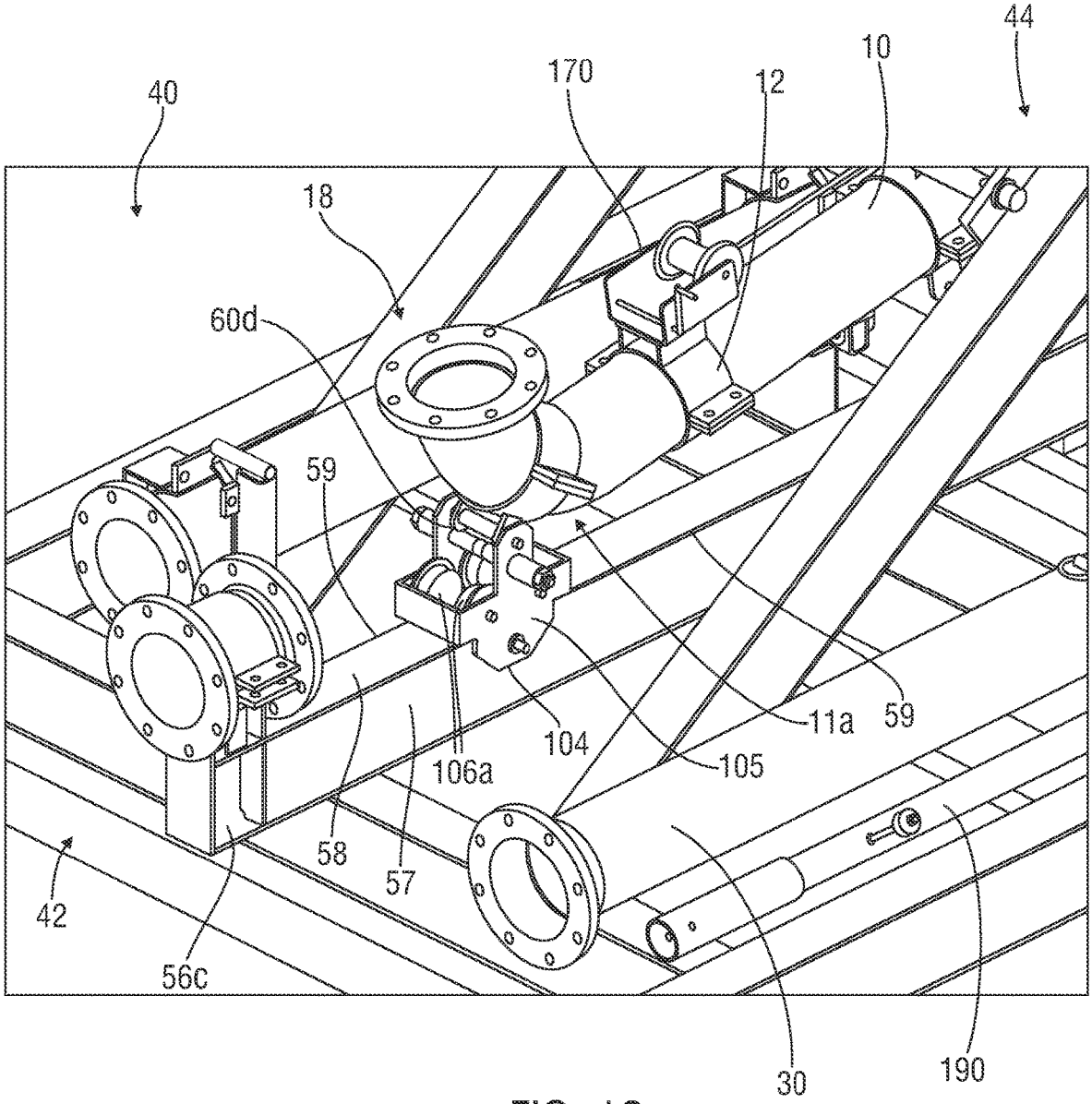
FIG. 12 is a perspective view of part of the exemplary flare stack transporter and components thereon of FIG. 1 taken from the front end in accordance with one or more embodiments of the present disclosure.

Referring to FIGS. 11 & 12, the illustrated first trolly 104 is moveable along, or relative to, at least one support 56 (third support 56*c*) of the transporter 40, so that when the first trolly 104 moves forward and rearward along the third support 56*c*, it carries or drags the lower end 18 of the flare stack 10 with it. In this embodiment, the first trolly 104 is pivotably coupled to the lower end 18 of the flow stack 10 at one or more pivot points 63, such as to allow the flare stack 10 to pivot thereabout upwardly (into a vertical position) and downwardly (into a lowered position) relative to the first trolly 104 and transporter 40 as the first trolly 104 moves rearward and forward, respectively. In this embodiment, at least one pivot pin 64 releasably couples the first trolly 104 to a bracket 60*d* rigidly (releasably) coupled to and extending generally in a rearward direction and/or from the back side 11*a* of the flare stack 10. However, any other arrangement of parts may be used.

Still referring to FIGS. 11 & 12, the first trolly 104 may be associated with the third support 56*c* (and/or other component(s) of the transporter 40) in any suitable manner. For example, the first trolly 104 may include one or more riders 106 that engage and/or ride at least partially along the third support 56*c* in any suitable manner. In this embodiment, the third support 56*c* is generally horizontally (or, if desired, may be angularly) oriented on the transporter 40 at least partially between the forward and rear ends 42, 44 thereof and includes at least one generally vertically-oriented web 57 with an upper flange 58 having opposing legs 59 extending outwardly from the web 57. At least one pair of upper and lower riders 106*a*, 106*b* of the illustrated first trolly 104 sandwich or straddle at least one leg 59 of the upper flange 58, such as to allow movement of the first trolly 104 along the third support 56*c*, prevent the trolly 104 from coming off, disengaging or flipping over the support 56*c*, help maintain the position, stability and linear and/or planar orientation of the flare stack 10 during lifting and lowering, for any other purpose(s) or a combination thereof.

In this embodiment, the riders 106 are wheels, or rollers, and the first trolly 104 includes two upper rollers 106*a* and one lower roller 106*b* sandwiching each respective leg 59 of the upper flange 58. The exemplary first trolly 106 includes a carriage 105 configured to carry the riders 106, pivot pin(s) 64 and a retractor connection rod 117 for engaging the cable 116 (or other component) of the retractor 114. The various components of the first trolly 104 are designed, for example, with the strength, durability and longevity to sufficiently support the weight of the flare stack 10 and related components, tension from the retractor 114 and any other forces that may be placed upon the first trolly 104 during movement and stationary positioning thereof. However, the riders 106 of the first trolly 104 may take any other suitable form (sliding plates, pins, etc.) and may be coupled together and used in any other manner. Further, any other combination or configuration of riders 106 and/or other components may be used to associate the first trolly 104 with the flare stack 10, third support 56*c* and/or other component(s) of the transporter 40 and help guide the flare stack 10 between positions in any other manner. Moreover, the first trolly 106 and associated components (e.g., support 56*c*) may have any other form or not be included, the retractor 114 may be coupled to or associated with the flare stack 10 in any other manner (e.g., without a first trolly 104) and the flare stack 10 may be moved between positions with any other form of erector 100 or in any other manner.

Referring now to FIGS. 3 & 9, any suitable configuration of components and techniques may be used help to lift and/or lower the upper end 16 of the flare stack 10 (into and out of operating positions). In some embodiments, one or more lifting systems 108 may assist in lifting and lowering the upper end 16 of the flare stack 10. When included, the lifting system(s) 108 may have any suitable form, configuration, components and operation. For example, the lifting system 108 includes at least a second roller guide, or trolly, 110 useful to assist in at least partially guiding the upper end 16 of the flare stack 10 upwardly and downwardly to and from one or more operating positions. In the present embodiment, the second trolly 110 is movable along one or more supports 56 of the flare stack transporter 40 and associated with the flare stack 10 so that rearward movement of the second trolly 110 helps guide the flare stack 10 into an operating position and forward movement of the second trolly 110 helps lower the flare stack 10 into a lowered position (e.g., to seat the flare stack 10 in the pipe saddle(s) 46).

When included, the second trolly 110 may have any suitable form, configuration, components and operation. In this embodiment, the second trolly 110 is selectively moveable along one or more angularly-oriented supports 56 of the transporter 40 and guides the flare stack 10 angularly (e.g., at approximately 45° or along any other path) upwardly and downwardly with it. For example, the second trolly 110 may be (e.g., releasably) pivotably coupled to the flare stack 10 at one or more pivot points 63 selectively spaced upwardly from the lower end 18 of the flare stack 10 to allow the upper end 16 of the flare stack 10 to pivot into an operating position as the first and second trollies 104, 110 move rearward on the transporter 40, and pivot into a lowered position and as the trollies 104, 110 move forward. In this embodiment, at least one pivot pin 64 releasably couples the second trolly 110 to a bracket 60*e* (e.g., FIG. 10) rigidly (releasably) coupled to and extending generally in a forward direction (e.g., from the front side 11*b* of the flare stack 10). Thus, the exemplary flare stack 10 will pivot into an operating position (e.g., FIG. 2) as the illustrated second trolly 110 and associated pivot point 64 climb up the angled supports 56*d*, 56*e* (or other component(s)). However, any other arrangement of parts and techniques may be used.

Figure 13:
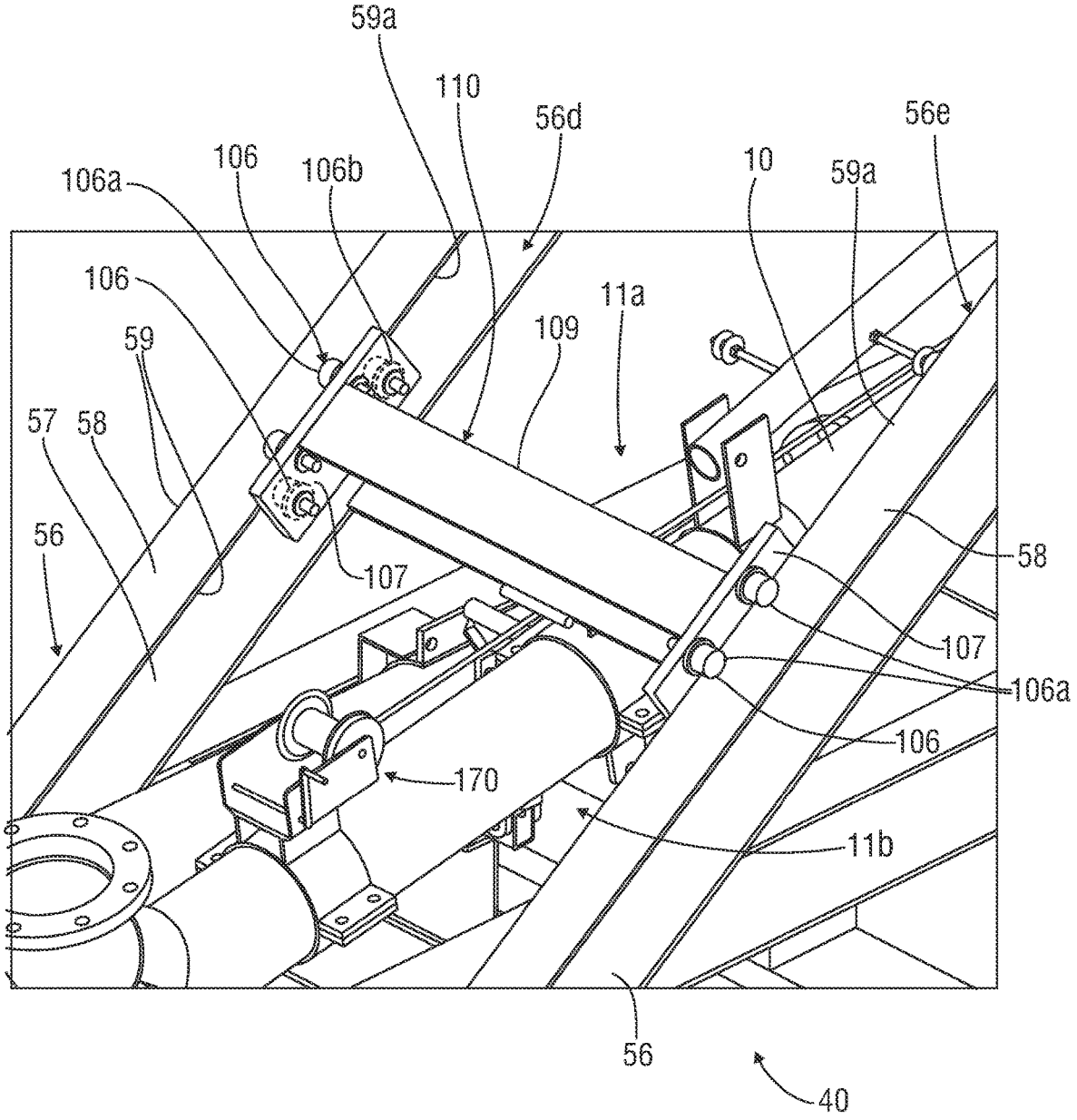
FIG. 13 is a perspective view of another part of the exemplary flare stack transporter and components thereon of FIG. 1 in accordance with one or more embodiments of the present disclosure.

Now referring to FIG. 13, the second trolly 110 may be associated with one or more supports 56 (and/or other component(s) of the transporter 40) in any suitable manner. In this embodiment, third and fourth generally parallel, spaced-apart, inclined supports 56*d*, 56*e* extend rearwardly and upwardly on the transporter 40 and are positioned generally outwardly of the respective left and right sides 11*c*, 11*d* of the flare stack 10, essentially forming a ramp for the second trolly 110. The exemplary second trolly 110 includes one or more riders 106 that engage and/or ride at least partially along each support 56*d*, 56*e*. For example, each support 56*d*, 56*e* may include a generally vertically-oriented web 57 with an upper flange 58 having opposing legs 59 extending generally horizontally outwardly from the web 57.

Still referring to FIG. 13, in the present embodiment, the second trolly 110 includes at least one pair of upper and lower riders 106*a*, 106*b* that respectively sandwich or straddle at least one leg 59 of the upper flange 58 of each support 56*d*, 56*e* to allow the desired movement of the trolly 110 along the third and fourth supports 56*d*, 56*e*, prevent the second trolly 110 from coming off, disengaging or flipping over the supports 56*d*, 56*e*, help maintain the position, stability and linear and/or planar orientation of the flare stack 10 during lifting and lowering, for any other purpose(s) or a combination thereof. For example, the riders 106 may be rollers, or wheels, and the second trolly 110 may include two upper rollers, or wheels, 106*a* and two lower wheels 106*b* sandwiching the inwardly facing leg 59*a* of the upper flange 58 of each support 56*d*, 56*e*. In this embodiment, the riders 106 on each side are carried on one or more rider carriers 107 (e.g., plates) and the rider carriers 107 are connected together with one or more cross-beams 109 (e.g., I-beam).

The various components of the second trolly 110 are designed, for example, with the strength, durability and longevity to sufficiently support the weight of the flare stack 10 and any downward pulling forces of the first trolly 104 or other components on the flare stack 10 during movement and stationary positioning thereof. However, the riders 106 of the second trolly 110 may take any other suitable form (sliding plates, pins, etc.) and may be coupled together or used in any other manner. Further, any other combination or configuration of riders 106 and/or other components may be used to associate the second trolly 110 with the flare stack 10, support(s) 56*d*, 56*e* and/or other component(s) of the transporter 40 and help guide the flare stack 10 up and down in any other manner. Moreover, the second trolly 110 and associated components (e.g., supports 56*d*, 56*e*) may have any other form, or may not be included, and the flare stack 10 may be guided up and down to and from a vertical position using any other components and techniques.

In the present embodiment, the exemplary trollies 104, 110 can effectively create the lift for raising the flare stack 10. However, the present disclosure is not limited to the use of trollies 104, 110 for helping move the flare stack 10 between positions and any other form of components and techniques may be used.

Figure 15:
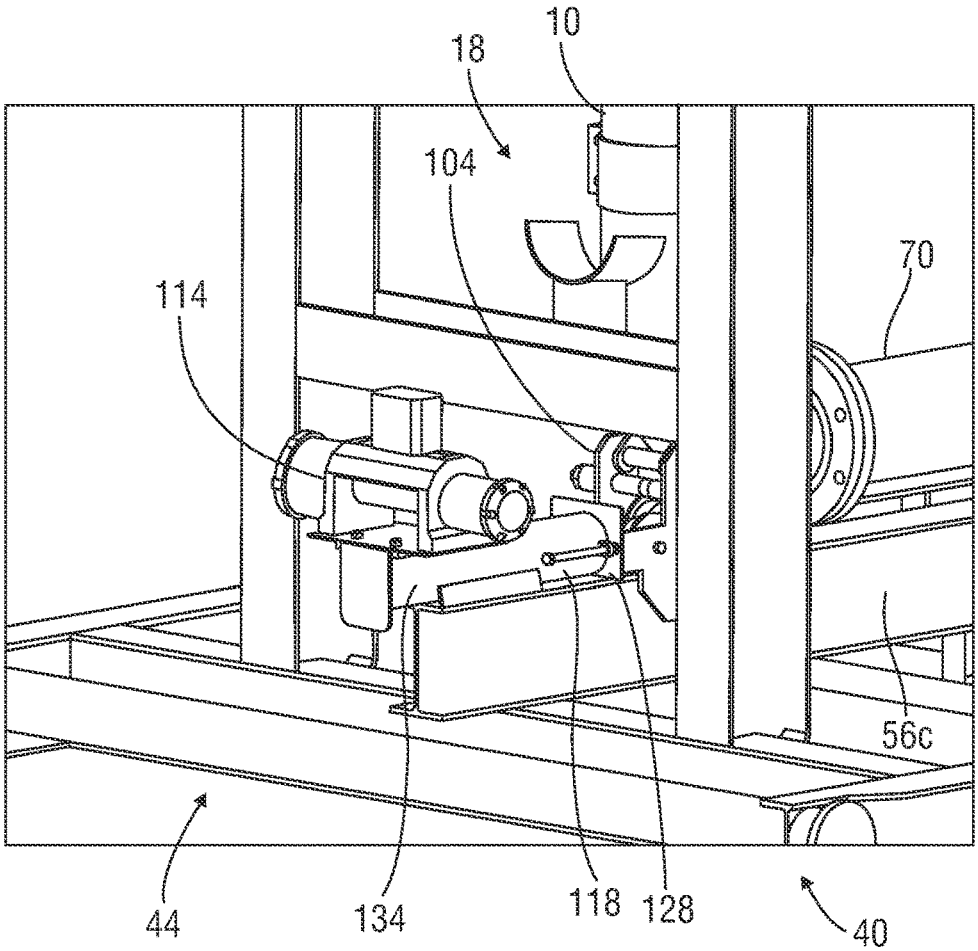
FIG. 15 a perspective view of part of the exemplary flare stack and components thereon of FIG. 2 taken from the rear end thereof in accordance with one or more embodiments of the present disclosure.
Figure 18:
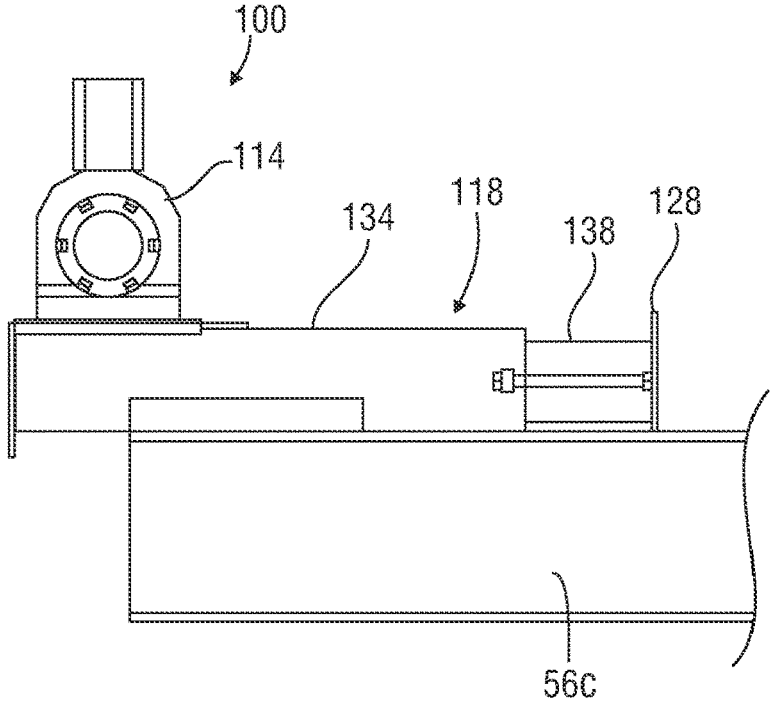
FIG. 18 is a side view of the exemplary retractor, forward driver and related components of FIG. 17 in accordance with one or more embodiments of the present disclosure.

Referring now to FIGS. 3 & 15, one or more forward drivers 118 may be included to assist in moving the flare stack 10 into at least one lowered position, for any other purposes or a combination thereof. In the present embodiment, the forward driver 118 pushes, or drives, the lower end 18 of the flare stack 10 forward relative to the transporter 40 from an operating position to at least start its forward movement in a lying down motion. The forward driver(s) 118, when included, may have any suitable form, configuration and operation. For example, the forward driver 118 may include at least one kick-out plate 128 (or other components) positioned behind the illustrated first trolly 104 and configured to push, kick-out or bias the first trolly 104 forward when the flare stack 10 is released from an operating position (e.g., FIG. 11).

Figure 16:
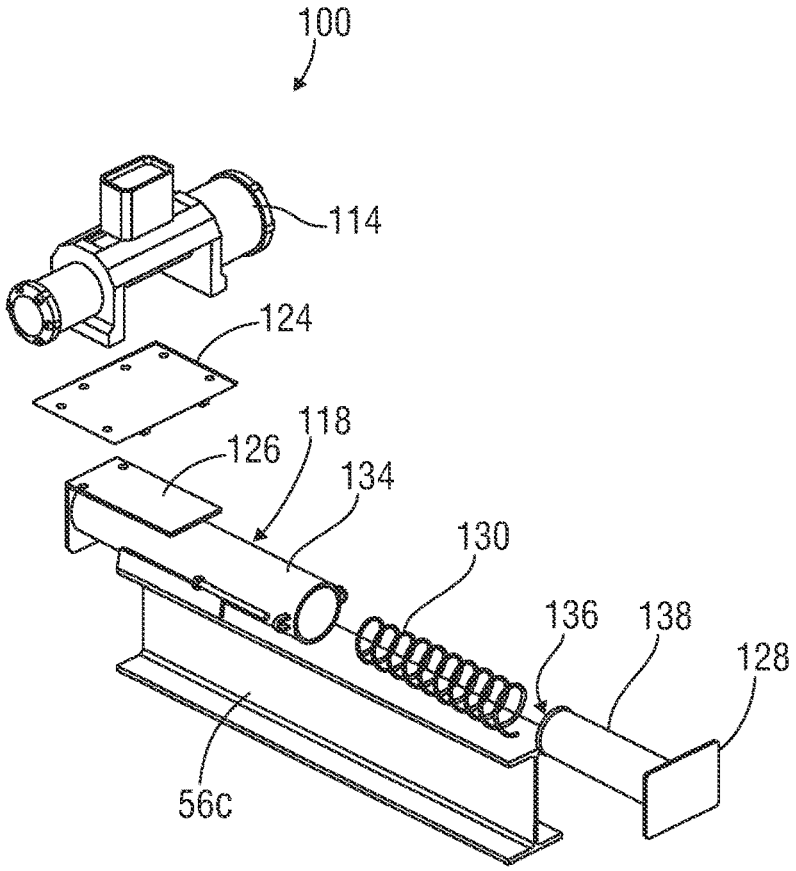
FIG. 16 is an exploded view of the exemplary retractor, forward driver and related components of FIG. 1 in accordance with one or more embodiments of the present disclosure.
Figure 17:
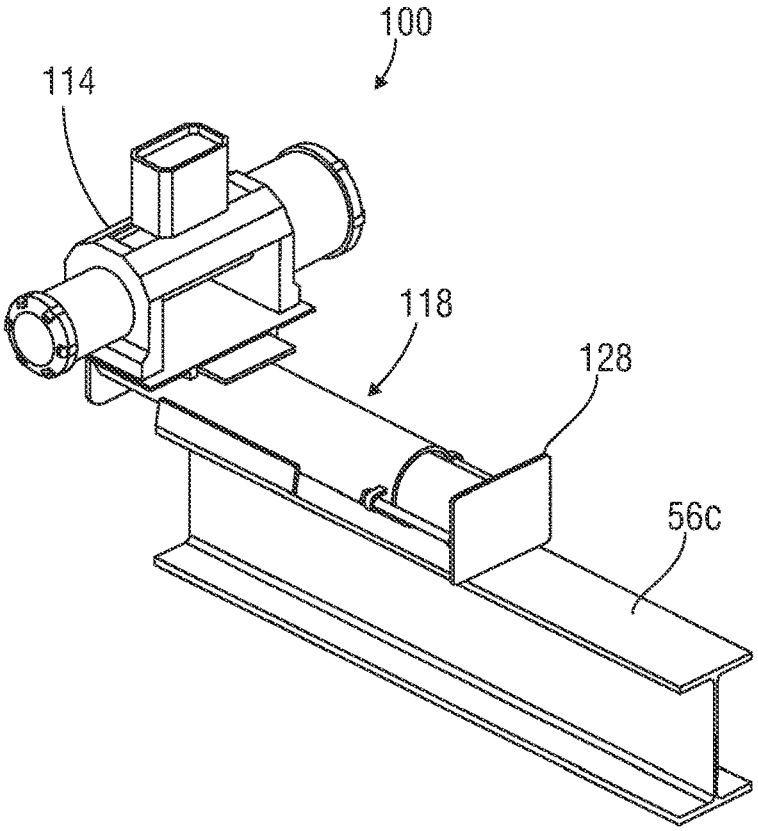
FIG. 17 is an assembled view of the exemplary retractor, forward driver and related components of FIG. 16 in accordance with one or more embodiments of the present disclosure.
Figure 19:
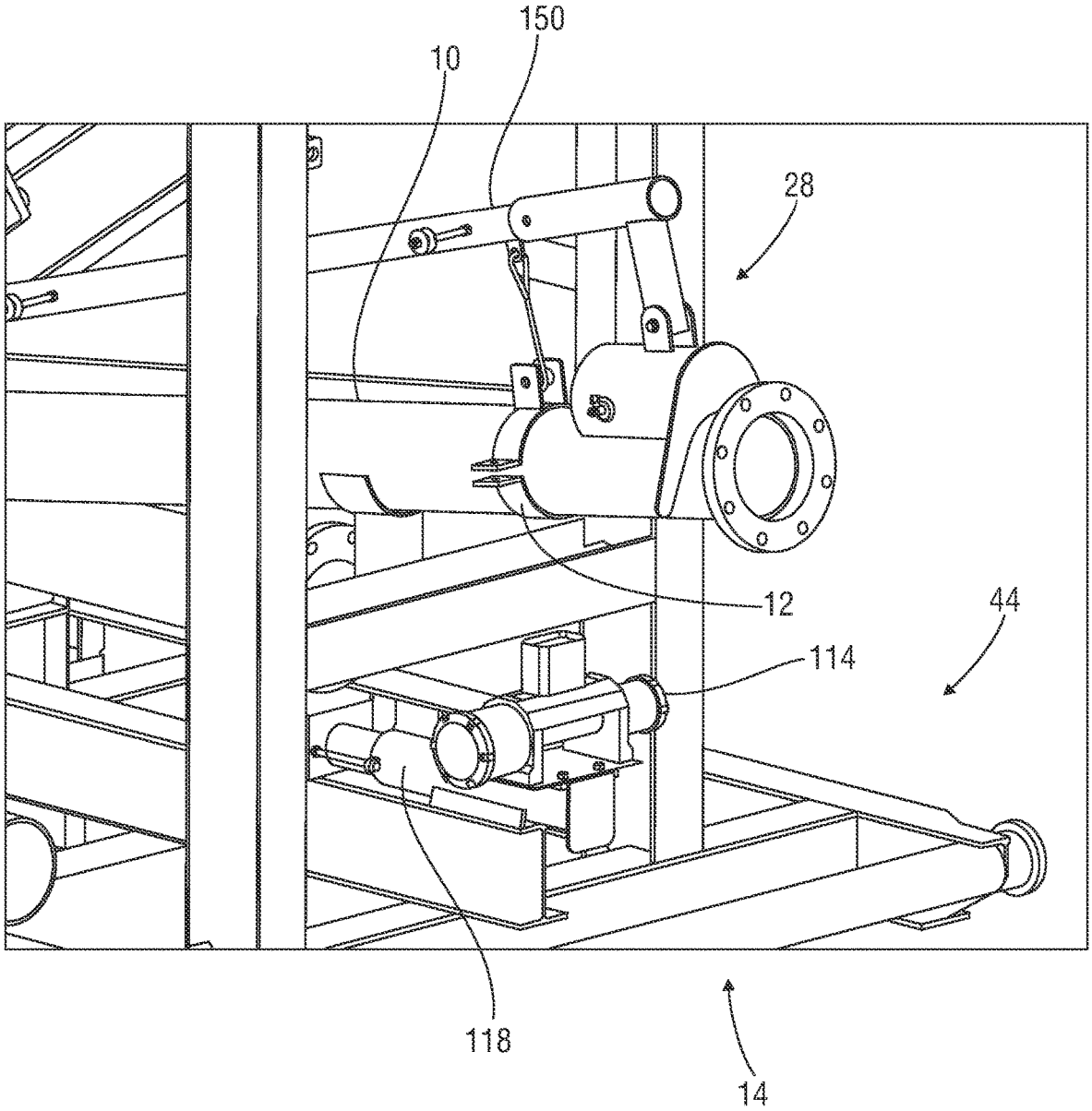
FIG. 19 is a perspective view of part of the exemplary flare stack transporter and components thereon of FIG. 1 taken from the rear end thereof in accordance with one or more embodiments of the present disclosure.

In the illustrated embodiment, as shown in FIG. 16, the kick-out plate 128 is spring-biased in the forward direction, such as by one or more springs 130 (e.g., coil spring, tension spring, etc. housed in a sleeve 134 of the forward driver 118 and extending into a cavity 136 in the base 138 of the kick-out plate 128) configured to apply forward biasing forces to the kick-out plate 128. The exemplary spring 130 is designed to be compressed (e.g., by the rearward movement of the first trolly 104) and loaded when the flare stack 10 is in an operating position (e.g., FIG. 2) and forceful enough when any anchors 52 are removed and the retractor 114 releases the flare stack 10 (e.g., letting off the winch) to push the first trolly 104 and lower end 18 of the flare stack 10 (and second trolly 110) forward, urging the flare stack 10 in a lying down motion.

At that time or thereafter, the momentum caused by those forward biasing forces, weight of the exemplary flare stack 10, gravity, travel of the illustrated trollies 104, 110, selective release of tension by the retractor 114 (e.g., winch) or a combination thereof, should typically cause the flare stack 10 to continue moving into a lowered position (e.g., without the need for on-site or hands-on operator involvement, such as by pulling on or swinging the flare stack 10). Thus, the lowering of the exemplary flare stack 10 should be automatic upon the release of the flare stack 10 by any anchors 52 and retractors 114. However, the spring 130, kick-out plate 128 and sleeve 134 may have any other form, configuration or operation and the forward driver 118 may have any other, fewer or additional components. Moreover, any other components and techniques (with or without a forward driver 118) may be used to help move the flare stack 10 into a lowered position. In some embodiments, if desired, one or more forward drivers 118 may be remotely controlled (e.g., via remote electronic or wireless controller, software, etc.), so that the flare stack 10 may be raised and/or lowered without any operators at or near the transporter 40 and/or for any other purposes.

Figure 34:
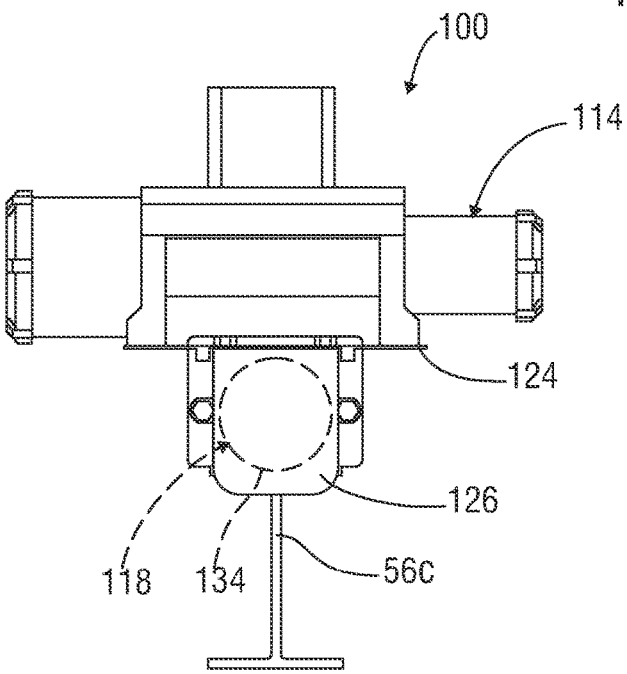
FIG. 34 is a rear view of the exemplary retractor, forward driver and related components of FIG. 17 in accordance with one or more embodiments of the present disclosure.
Figure 35:
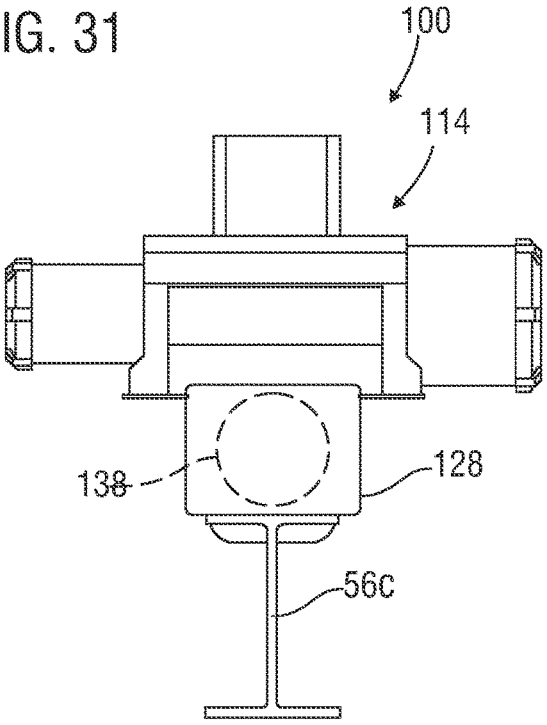
FIG. 35 is a front view of the exemplary retractor, forward driver and related components of FIG. 17 in accordance with one or more embodiments of the present disclosure.
Figure 32:
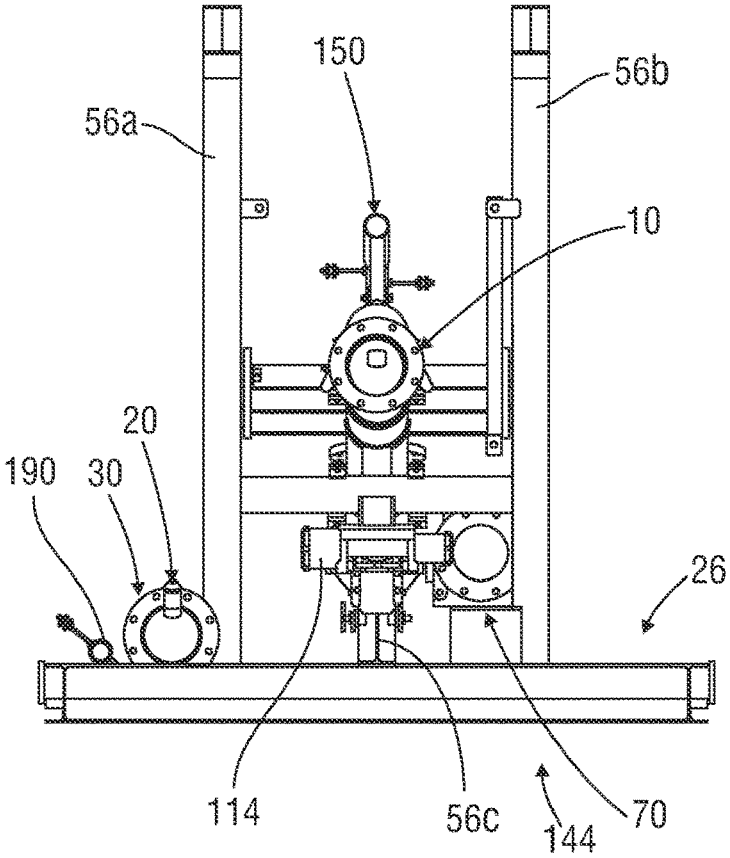
FIG. 32 is a rear view of the exemplary flare stack transporter of FIG. 1 in accordance with one or more embodiments of the present disclosure.
Figure 33:
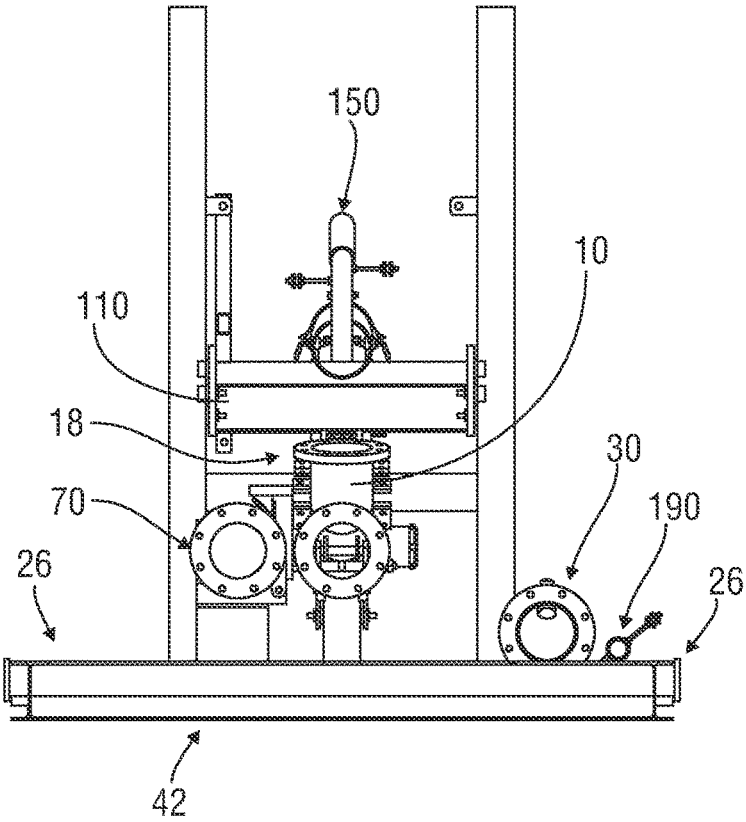
FIG. 33 is a front view of the exemplary flare stack transporter of FIG. 1 in accordance with one or more embodiments of the present disclosure.

Referring to FIGS. 15-19, if desired, the forward driver 118 may be provided on the flare stack transporter 40 proximate to the rear end 44 thereof, such as for easy and quick access thereto, to position the kick out plate 128 (or other components) directly behind and aligned with the first trolly 104, to allow unimpeded movement of the flare stack 10 between operating and lowered positions (e.g., FIG. 28), to optimize the use of space and/or distribution of weight on the transporter 40, for any other purpose(s) or a combination thereof. In this embodiment, the forward driver 118 is sandwiched between the retractor 114 and third support 56*c*. For example, the illustrated retractor 114 is shown releasably mounted to a mounting bracket 124, which rests upon and releasably engages a receiving bracket 126 provided on the forward driver 118, which is mounted to or upon the third support 56*c* (e.g., FIGS. 34-35).

However, the forward driver 118, retractor 114 and related components may be mounted to or associated with the flare stack transporter 40 in any other configuration and manner, with any other components and operation or may not be included. For example, the retractor and/or forward driver 118 may instead or also engage the second trolly 110, flare stack 10 or other components, may be located in any desired location on the transporter 40 (e.g., at the front end 42 or one or more sides thereof), move one or more trollies 104, 110 or flare stack 10 in the opposite directions as mentioned above or both directions, include one or more electric motors, hydraulic or pneumatic pistons or other devices, one or more PLCs or other electronic devices, encoders and/or sensors, other components, or any combination thereof. Thus, the type, configuration and operation of the erector 100 and forward driver 118 are not limiting upon the present disclosure.

Figure 20:
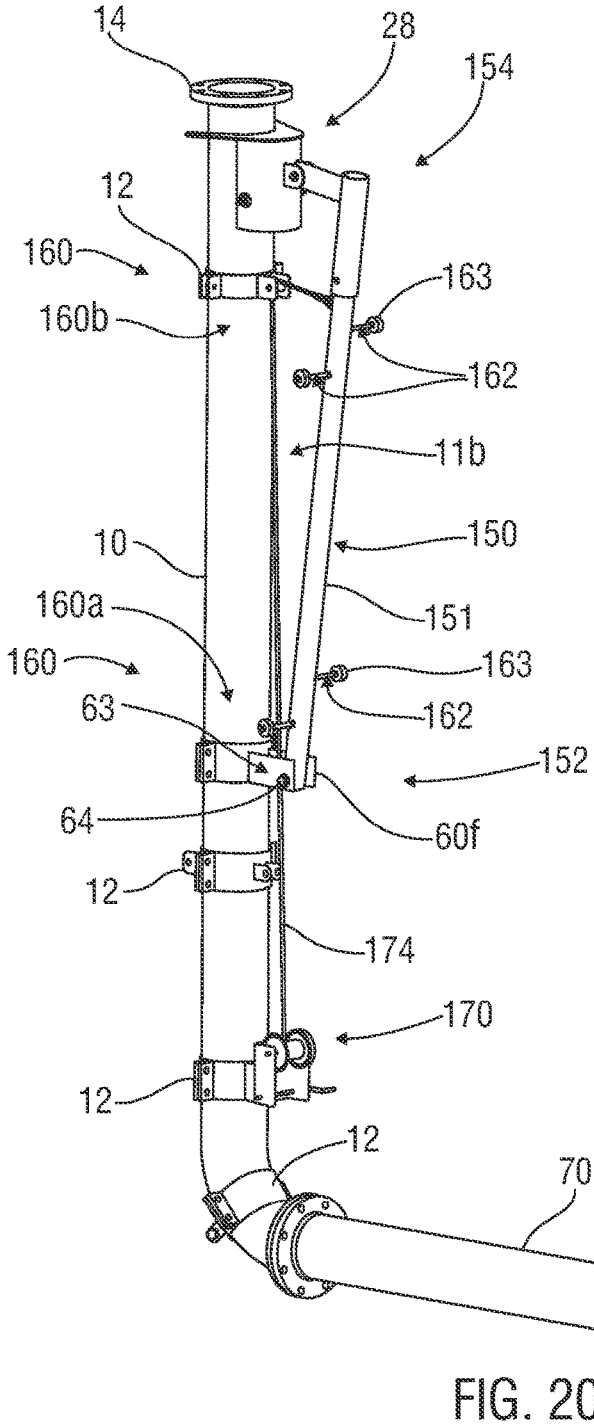
FIG. 20 is an isolated view of the exemplary flare stack and related components of FIG. 2 in accordance with one or more embodiments of the present disclosure.
Figure 14:
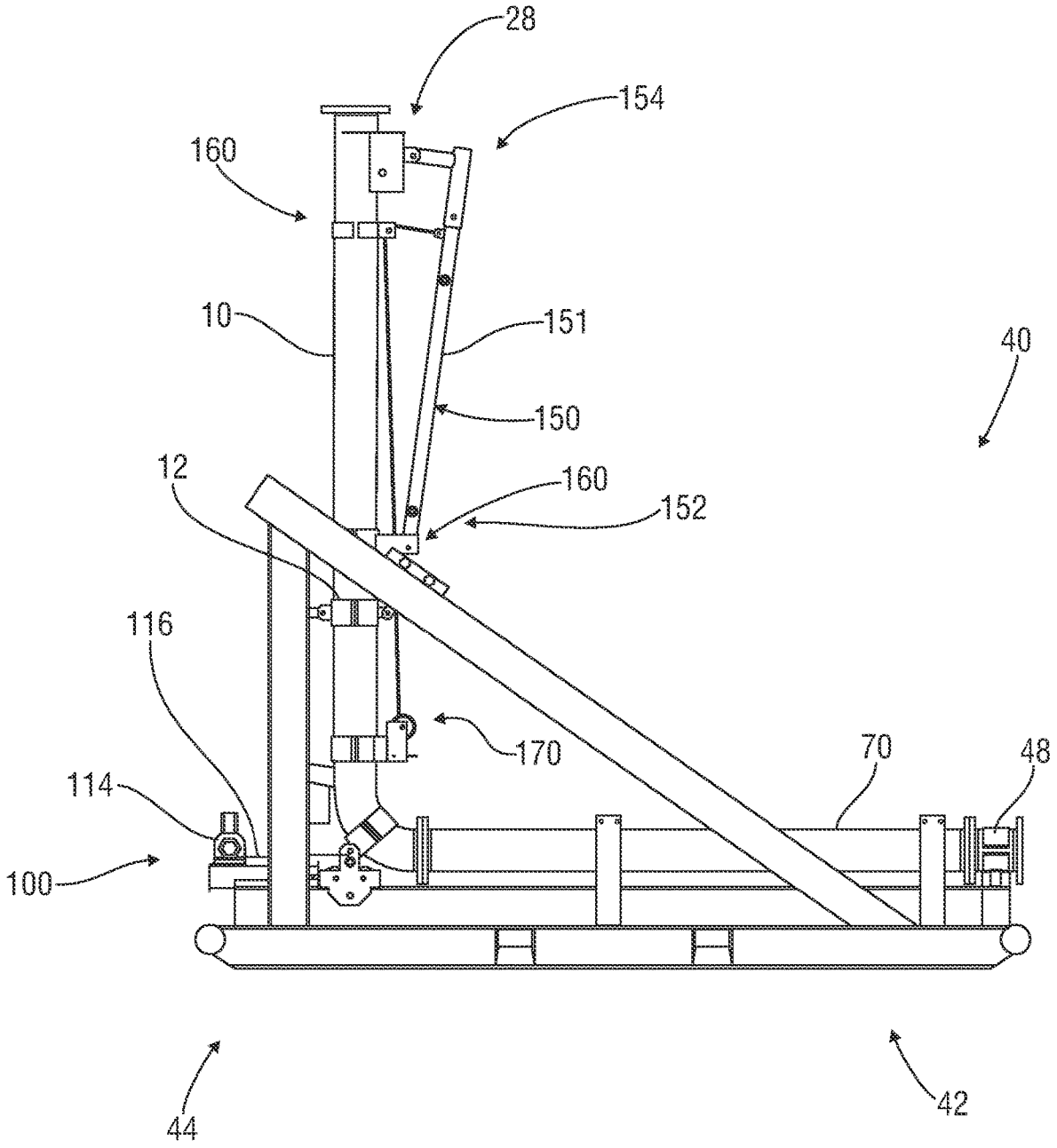
FIG. 14 is a side view of the flare stack transporter and components thereon of FIG. 2 in accordance with one or more embodiments of the present disclosure.

Referring now to FIGS. 14 & 20, one or more flare stack igniters 28 may have any suitable form, configuration, components and operation and be associated with the flare stack 10 in any suitable manner. For example, the flare stack igniter(s) 28 may be provided on one or more ignition booms 150. The ignition boom 150 may likewise have any suitable form, configuration, components and operation. In the present embodiment, the ignition boom 150 includes one or more beams 151 (e.g., lightweight, sufficiently heat-resistant, 2" steel pipe) that carry the igniter 28 and corresponding components (e.g., insulated guides 163 and guide holders 162 for guiding electrode wires) needed to ignite gas exiting the flare stack 10 or used for any other purposes.

Figure 21:
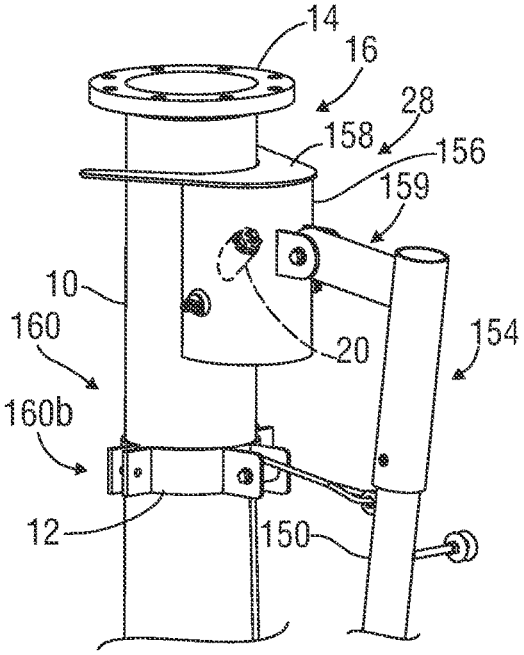
FIG. 21 is a perspective view of part of the exemplary flare stack and related component of FIG. 20 in accordance with one or more embodiments of the present disclosure.

As shown in FIG. 21, the illustrated igniter 28 includes an igniter housing 156 configured to carry electrodes (not shown) therein and properly position the arc created thereby relative to one or more ignition feed outlets 20 (e.g., FIG. 22) of the flare stack 10 for operation thereof, and may also include one or more straddle plates 158 that assist in positioning the igniter housing 156. The igniter 28 may be solar-powered with battery backup (not shown) or powered in any other suitable manner. If desired, the exemplary igniter 28 may be releasably coupled to the ignition boom 150, such as to allow ease of inspection, servicing, maintenance, replacement, to allow attachment of one or more ignition boom extensions 190 (e.g., FIG. 4), for any other purpose(s) or a combination thereof. In the present embodiment, the igniter 28 is releasably engaged with a coupling 159, which is releasably coupled to the ignition boom 150 (e.g., with one or more pins), such as to allow for ease of removal, servicing, replacement, etc. However, the igniter 28 may have any other components and be coupled to the ignition boom 150 in any other manner.

Referring back to FIGS. 14 & 20, the illustrated ignition boom 150 is moveable with the flare stack 10 between operating lowered positions and also selectively moveable relative to the flare stack 10. Thus, while the flare stack 10 is in an operating position, for example, the exemplary ignition boom 150 may be lowered as needed (e.g., FIG. 24-27) and then raised back into an ignition-boom operating position without moving the flare stack 10, allowing quick, easy and precise servicing, maintenance, repair and inspection of the igniter(s) 28 and related components, eliminating the need for any operators to climb to the top of the flare stack 10 to perform such activities, saving time, effort and cost, allowing the flare stack 10 to continue operating while lowering (e.g., and servicing) the ignition boom 150, for any other purpose(s) or a combination thereof.

When included, the ignition boom 150 may be moveable with and relative to the flare stack 10 in any suitable manner. For example, the ignition boom 150 may be coupled to the flare stack 10 with one or more ignition boom connectors 160 that allow the concurrent movement of the ignition boom 150 and the flare stack 10 as the flare stack 10 is moved between lowered and operating positions and/or the independent movement of the ignition boom 150 relative to the flare stack 10. In this embodiment, at least a first ignition boom connector 160*a* and related components couple the ignition boom 150 to the flare stack 10 at or proximate to the lower end 152 of the ignition boom 150 (or at one or more intermediate locations) and at least a second ignition boom connector 160*b* and related components couple the ignition boom 150 to the flare stack 10 at or proximate to the upper end 154 (or at one or more intermediate locations) of the ignition boom 150, allowing their concurrent movement up and down relative to the transporter 40. Thus, as the exemplary flare stack 10 is moved between operating and lowered positions, the illustrated ignition boom 150 will move along with it. One or more ignition boom connectors 160 (or other components) may also, or instead, allow the ignition boom 150 to be (e.g., pivotably or otherwise) moved relative to the flare stack 10.

Referring to FIGS. 20 & 21, the ignition boom connector(s) 160 may have any suitable form, configuration, components, location and operation. For example, one or more connectors 160 may include at least one pivot point 63 that allows the ignition boom 150 to be selectively movable between one or more ignition-boom operating positions (e.g., FIGS. 14, 27) and one or more ignition-boom lowered positions (e.g., FIG. 24-26) relative to the flare stack 10. In the present embodiment, the first connector 160*a* includes at least one bracket 60*f* (e.g., FIG. 10) rigidly (e.g., releasably) coupled to the flare stack 10, extending generally in a forward direction (e.g., from the front side 11*b* of the flare stack 10) and which is coupled to the ignition boom 150 with at least one pivot pin 64, allowing the ignition boom 150 to pivot near its lower end 152 relative to the flare stack 10 without disturbing the flare stack 10. However, in other embodiments, the bracket 60*f* (or other components) may instead extend from the ignition boom 150, or multiple or no brackets 60 may be used. Similarly, the pivot point 63 may not involve any pivot pins 64, but instead include other component(s) to cause the desired pivoting movement.

The movement of the ignition boom 150 between ignition-boom operating and ignition-boom lowered positions relative to the flare stack 10 may be selectively controlled in any suitable manner. For example, one or more automated and/or manually-operated ignition boom controllers 170 (e.g., motor, hydraulic or pneumatic position, PLC, hand crank) may be used to help raise and lower the ignition boom 150. The illustrated controller 170 is a manually-operated winch (e.g., via impact wrench or electric gun), but could be automated or remotely controlled (e.g., to avoid operator presence at the flare stack 10) or have any other form, configuration and operation.

Still referring to FIGS. 20 & 21, the ignition boom controller(s) 170 may have any suitable form, configuration and operation. For example, one or more retractable control lines 174 (e.g., cables) may be coupled between the controller 170 (and/or other component) and ignition boom 150 to help control movement of the ignition boom 150 relative to the flare stack 10. In this embodiment, a single control line 174 extends from the controller 170 (e.g., mounted to the flare stack 10 near its lower end 18 or at an intermediate location, or to any other component, for easy operator access), over one or more rollers, pulleys or the like 180 (e.g., coupled to the flare stack 10 at the second connector 160*b*) at desired height (e.g., height of 13' on a 15' high flare stack) and anchored to the ignition boom 150. The illustrated controller 178 may be selectively actuated to drawn in or let out the control line 174 to move the ignition boom 150 between positions relative to the flare stack 10 (e.g., FIGS. 24-27). However, any other type and configuration of components may be used to allow the ignition boom 150 to move with and/or relative to the flare stack 10.

Referring back to FIG. 4, when included, one or more ignition boom extensions 190 may be releasably coupled to the ignition boom 150, such as to increase the height of the igniter 28 when the height of the flare stack 10 is extended (e.g., with one or more flare stack extensions 30) and/or for any other purpose(s). The ignition boom extension(s) 190 may have any suitable form, configuration, components and operation. In this embodiment, the ignition boom extension 190 includes one or more beams 151 capable of carrying one or more igniters 28 and corresponding components (e.g., wiring) needed to ignite gas exiting the flare stack 10, similarly as described above for the ignition boom 150.

Figure 23:
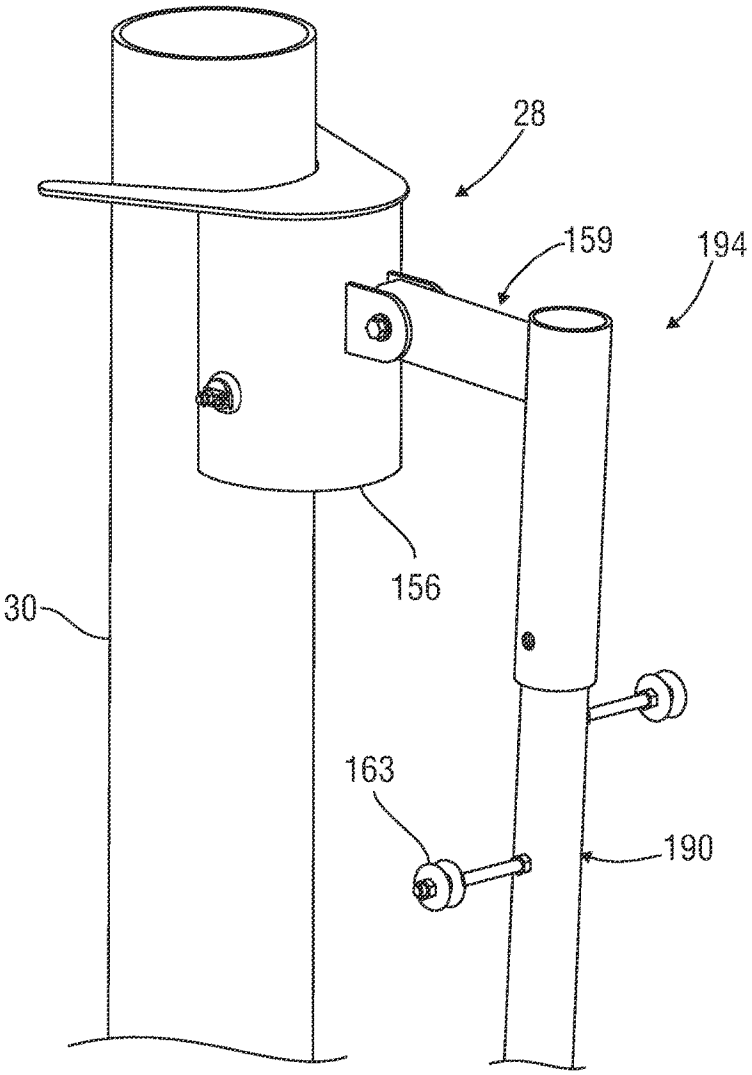
FIG. 23 is a perspective view of part of the exemplary flare stack extension and related component of FIG. 4 in accordance with one or more embodiments of the present disclosure.
Figure 22:
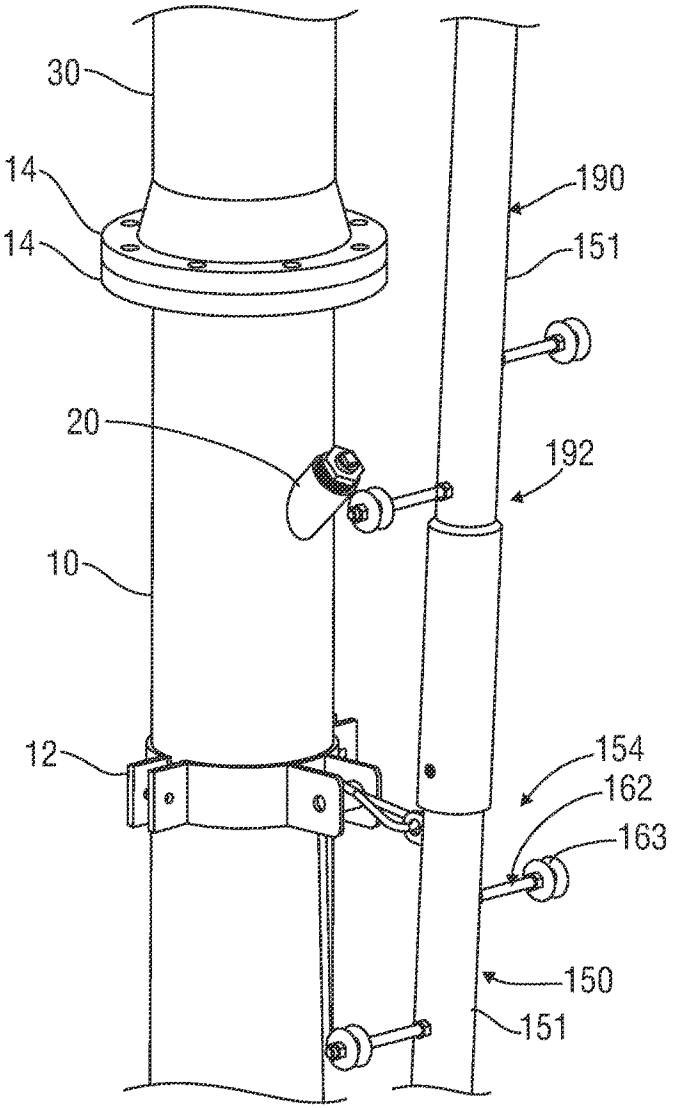
FIG. 22 is a perspective view of part of the exemplary flare stack and related component of FIG. 4 in accordance with one or more embodiments of the present disclosure.
Figure 24:
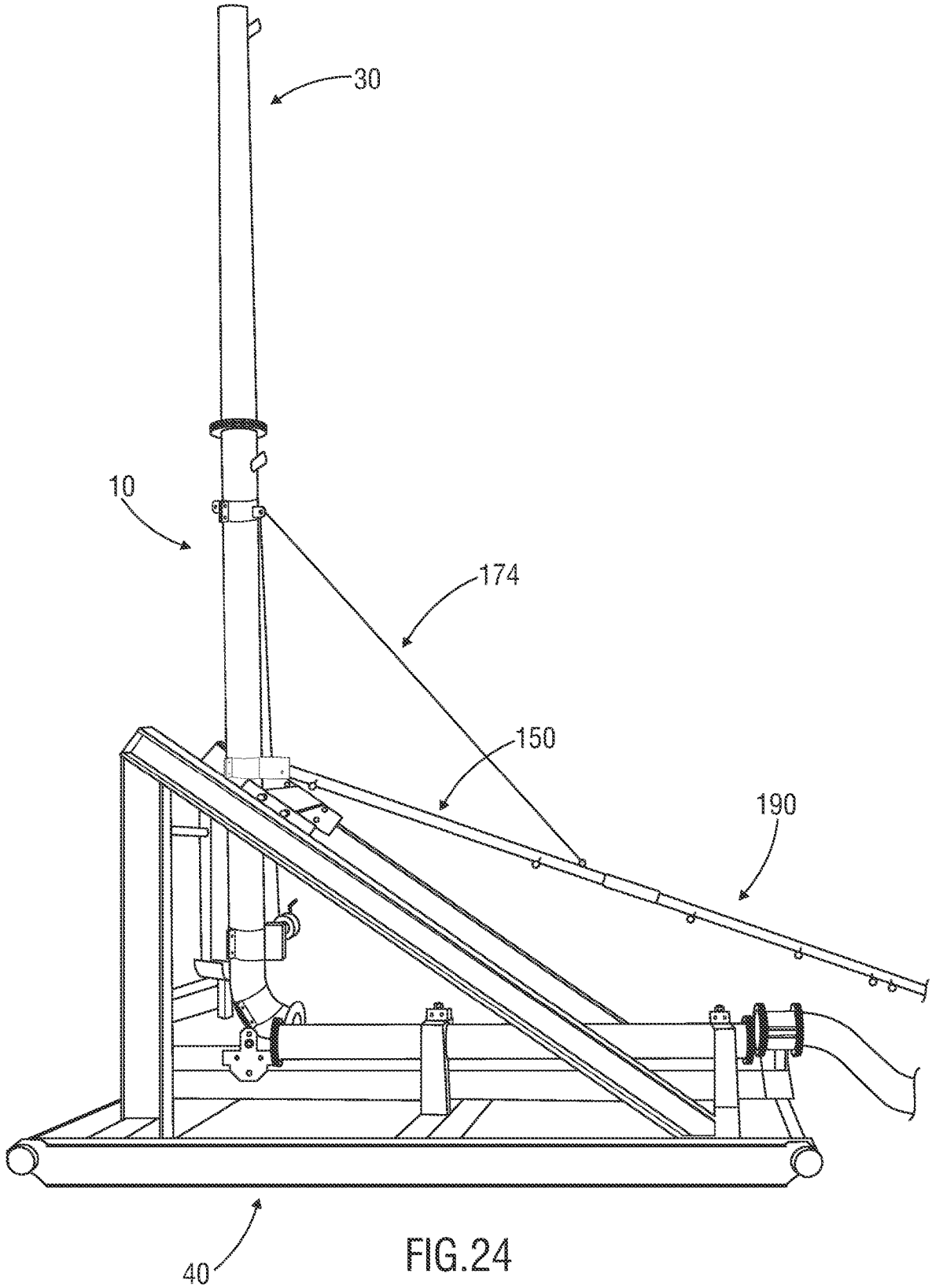
FIG. 24 is a perspective view of the exemplary flare stack transporter and components thereon of FIG. 4 showing the exemplary ignition boom and ignition boom extension in an exemplary lowered position in accordance with one or more embodiments of the present disclosure.
Figure 25:
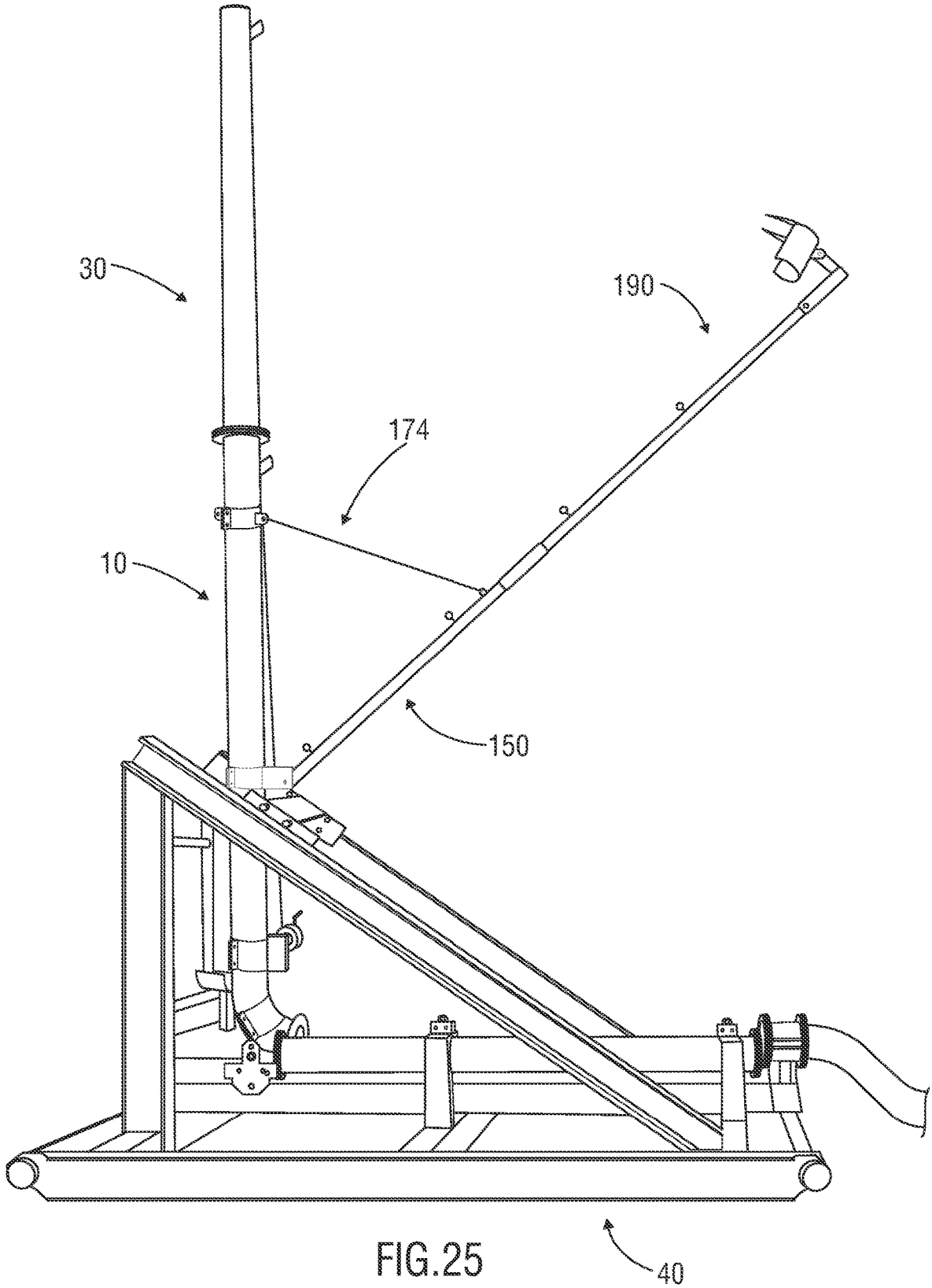
FIG. 25 is a perspective view of the exemplary flare stack transporter and components thereon of FIG. 4 showing the exemplary ignition boom and ignition boom extension in a partially lowered position in accordance with one or more embodiments of the present disclosure.
Figure 26:
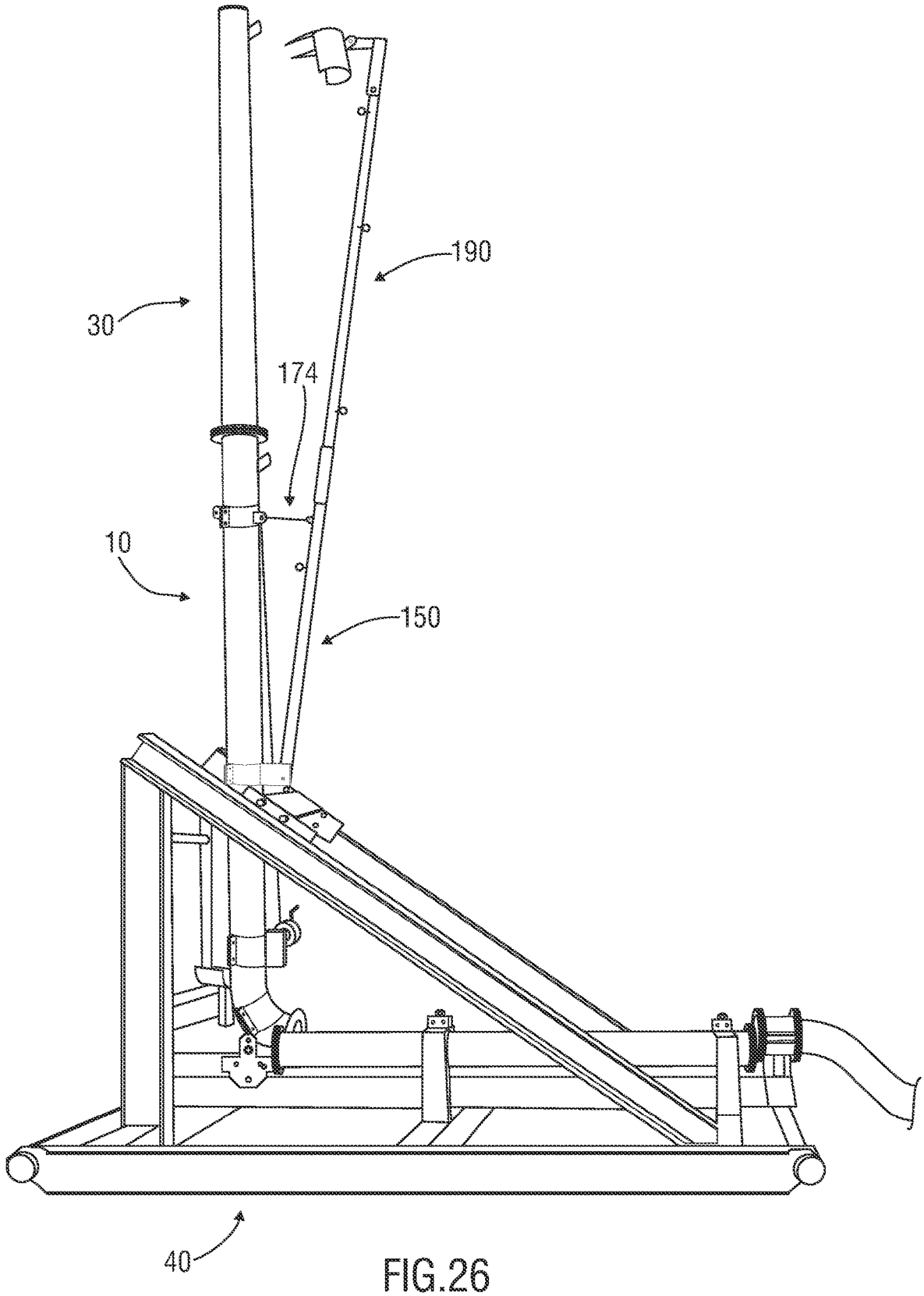
FIG. 26 is a perspective view of the exemplary flare stack transporter and components thereon of FIG. 4 showing the exemplary ignition boom and ignition boom extension in a nearly upright operating position in accordance with one or more embodiments of the present disclosure.
Figure 27:
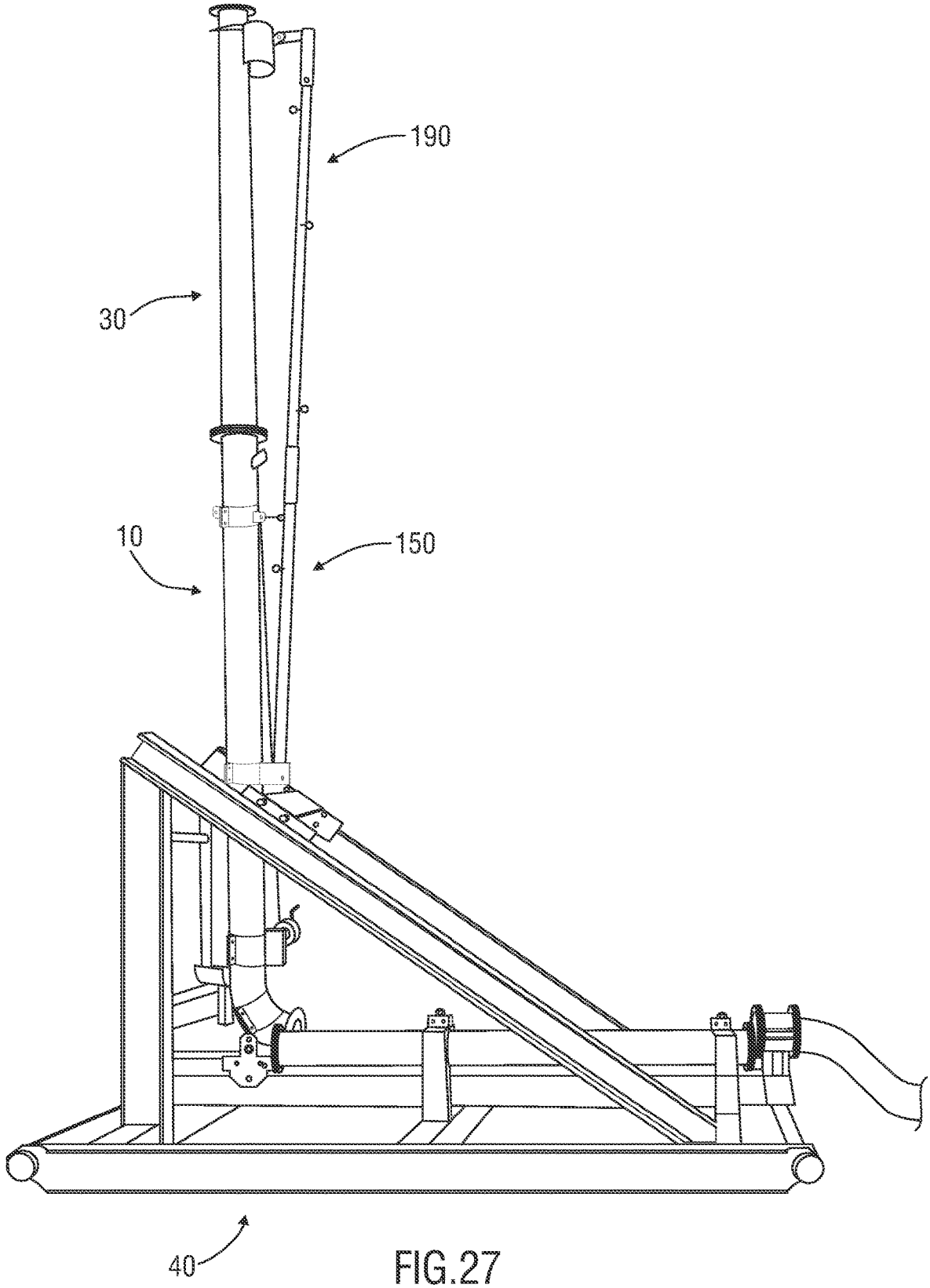
FIG. 27 is a perspective view of the exemplary flare stack transporter and components thereon of FIG. 4 showing the exemplary ignition boom and ignition boom extension in an exemplary upright operating position in accordance with one or more embodiments of the present disclosure.

Referring to FIGS. 21-23, the exemplary ignition boom extension(s) 190 may be coupled to the ignition boom 150 and used in connection the flare stack 10 in any suitable manner. In the present embodiment, the lower end 192 of the ignition boom extension 190 can be releasably coupled to the upper end 154 of the ignition boom 150 (e.g., after the igniter 28 is removed from the ignition boom 150), such as with one or more bolts, pins, brackets or other connectors, by snap-fit, threadable or sliding engagement or in any other manner. This can be done, for example, without the need for any tools, handling or lifting equipment, such as when the flare stack 10 or ignition boom 150 are in a lowered position. One or more igniters 28 (e.g., with components and operation similarly as described above with respect to the ignition boom 150) are provided at, or coupled to, the ignition boom extension 190 (e.g., at its upper end 194, similarly as described above with respect to the ignition boom 150).

Referring back to FIG. 3, if desired, one or more ignition boom extensions 190 may be stowed or stored on the exemplary flare stack transporter 40 when the extension 190 is not in use, such as for proper positioning of components, to allow unimpeded movement of the flare stack 10 between operating and lowered positions, for easy and quick access thereto, to optimize the use of space and/or distribution of weight on the transporter 40, for any other purpose(s) or a combination thereof. For example, the ignition boom extension(s) 190 may be held on or in the transporter 40 in or with one or more brackets, clamps, bolts, clips, etc., or a combination thereof or in any other manner.

However, the ignition boom extension 190 may have any other form, configuration, components and operation. Moreover, any other components and techniques may be used to increase or decrease the height of the ignition boom 150, if desired. For example, the ignition boom 150 may have one or more telescoping members or portions (not shown) to allow its height to be selectively increased or decreased as desired.

Referring now back to FIG. 4, the exemplary flare stack transporter 40 includes a base 26, such as a skid, having a number of base members 24. The base members 24 may have any suitable form, configuration, location and operation. For example, two or more side beams 25 (e.g., I-beams) and two or more cross beams 27 (e.g., I-beams) may be rigidly secured together (e.g., via weld, bolt, etc.) or formed integrally to sufficiently support the flare stack 10 and other components on the transporter 40. If desired, the transporter 40, with the flare stack 10 and other components secured thereto, could be configured to be transportable and mobile as a single unit movable from site to site. For example, the base 26 may include two or more (e.g., side-mounted) forklift lifting slots 36 and/or two or more (e.g., front and/or rear mounted) loading pad eyes, or loading hitches, 38 for ease of lifting and transport or any other purposes. However, the transporter 40 may have any other configuration, components and operation.

Any actions that are described above or which may be apparent from the present disclosure as being performable manually, or by an operator, can be automated (e.g., with computer software and hardware components, hydraulic or pneumatic pistons, electric or non-electric motors, electronic controllers (e.g., PLCs) or other devices (e.g., encoders, sensors, cameras, lasers, robotics, optical device, etc.). Thus, if desired, any parts of, or the entire, operation in the use of the flare stack transporter 40 and the rig up, rig down and operation of the flare stack 10 and ignition boom 150 may be automated and without operators at the transporter 40.

All the exemplary components described above are/or shown in the appended figures or which may be apparent therefrom are designed, configured and located for easy and quick access thereto, to be sturdy, durable and long-lasting, to contribute to the stability of the flare stack transporter 40 and be easily and quickly accessed, inspected, disassembled, repair, replacement, servicing, etc., to allow unimpeded movement of the flare stack 10 between operating and lowered positions, to optimize the use of space and positioning of component and distribution of weight on the transporter 40, or a combination thereof. If desired, any of the components or actions associated with the flare stack 10 and transporter 40 can be provided with redundancy, such as to provide a backup in case of failure or malfunction, to help balance and maintain stability of flare stack 10 and/or the transporter 40, for any other purpose or a combination thereof.

With respect to any "pivot points" included in or associated with any of the components, features or techniques described or shown herein, or as may be apparent from the above description or appended drawings, any components that cause the desired pivoting movement may be used. The present disclosure is thus not limited to particular pivot-related components described above or shown in the appended drawings. For example, while a pivot pin may be suggested or shown used in connection with one or more brackets, the present disclosure is not limited to that particular arrangement. Some embodiments may not have any such components and/or a different component, or combination of components, may be substituted for it, perform the same action or cause the same result.

Whenever a bracket, connector, coupling or the like is suggested above or shown in the appended drawings, the present disclosure is not limited to that particular type, configuration and location of the bracket, connector or coupling. For example, a bracket may be described or shown as extending from a particular component and/or in a particular orientation or direction, but could, in other embodiments, extend from a different component and/or orientation or direction. Some embodiments may not have any such bracket, connector, coupling or the like and a different component or combination of components may be substituted for it, perform the same action or cause the same result.

Preferred embodiments of the present disclosure thus offer advantages over the prior art and are well adapted to carry out one or more of the objects of this disclosure. However, the present invention does not require each of the components and acts described above and is in no way limited to the above-described embodiments and methods of operation. Any one or more of the above components, features, aspects, capabilities and processes may be employed in any suitable configuration without inclusion of other such components, capabilities, aspects, features and processes. Thus, embodiments of the present disclosure may have any one or more of the features described or shown in this patent. Moreover, the present invention includes additional features, capabilities, functions, methods, uses and applications that have not been specifically addressed herein but are, or will become, apparent from the description herein, the appended drawings and claims.

The methods that may be described above, claimed herein or are apparent from this patent and any other methods which may fall within the scope thereof can be performed in any desired or suitable order and are not necessarily limited to any sequence described herein or as may be listed in any appended claims. Further, the methods of various embodiments of the present disclosure may include additional acts beyond those mentioned herein and do not necessarily require use of the particular embodiments shown and described herein, but are equally applicable with any other suitable structure, form and configuration of components.

While exemplary embodiments have been shown and described, many variations, modifications and/or changes of the system, apparatus, articles of manufacture and methods of the present disclosure, such as in the features, components, details of construction and operation and arrangements thereof and the manufacture, assembly and use thereof, are possible, contemplated by the present patentee, within the scope of any appended claims, and may be made and used by one of ordinary skill in the art without departing from the spirit, teachings and scope of this disclosure and any appended claims. Thus, all matter herein set forth or shown in the accompanying drawings should be interpreted as illustrative and the scope of this disclosure and any appended claims should not be limited to the embodiments described or shown herein.

The invention claimed is:

1. A system for erecting a flare stack into at least one upright operating position, the flare stack having upper and lower ends, the system comprising:

a flare stack transporter having front and rear ends, wherein the flare stack can be carried on the transporter in a lowered position with its upper end closest to the rear end of the transporter and its lower end closest to the front end of the flare stack transporter;

at least a first retractor mounted on the transporter and associated with the flare stack, the first retractor including at least one hydraulic or pneumatic piston and being selectively actuated to help draw the lower end of the flare stack rearward in the direction of the rear end of the transporter; and at least a first trolly mounted on the transporter and associated with the flare stack, the first trolly being useful to help move the upper end of the flare stack upwardly until the flare stack is in at least one upright operating position.

2. The system of claim 1 wherein the first retractor includes at least one winch.

3. The system of claim 1 wherein the first trolly is configured to help move the upper end of the flare stack upwardly concurrently with the rearward movement of the lower end of the flare stack.

4. The system of claim 1 wherein the first trolly is movable along at least a first support on the transporter, the first trolly being pivotably coupled to the flare stack so that movement of the first trolly in the direction of the rear end of the transporter helps guide the flare stack into at least one upright operating position and movement of the first trolly in the direction of the front end of the transporter helps lower the flare stack into at least one lowered position.

5. The system of claim 4 wherein the first support is angularly-oriented support on the transporter and the first trolly is configured to move at least partially in an angular path along the first support.

6. The system of claim 1 further including at least a second trolly mounted on the transporter and coupled to the flare stack, the second trolly being movable at least partially in a generally horizontal path and configured to help move the lower end of the flare stack rearward in the direction of the rear end of the transporter concurrently with the first trolly helping guide the flare stack into at least one upright operating position.

7. A system for raising and lowering a flare stack between at least one upright position and at least one lowered position and raising and lowering a flare stack ignitor relative to the flare stack in at least one upright position, the flare stack having upper and lower ends, the system comprising:

a flare stack transporter having front and rear ends, wherein the flare stack can be carried on the transporter in at least one lowered position with its upper end closest to the rear end of the transporter and its lower end closest to the front end of the flare stack transporter;

at least a first guide mounted on the transporter and pivotably coupled to the flare stack, the first guide being moveable at least partially in an angular path on the transporter and configured to help guide the upper end of the flare stack upwardly and downwardly between at least one upright position and at least one lowered position;

a flare stack ignition boom carrying the flare stack igniter and being separate and distinct from the flare stack; and at least one connector coupled between the flare stack and the flare stack ignition boom and configured to allow the flare stack ignition boom to be selectively pivotably movable relative to the flare stack so that the flare stack igniter can be raised and lowered in a pivoting motion relative to the flare stack in at least one upright position.

8. The system of claim 7 wherein the at least connector includes at least one pivot pin.

9. The system of claim 7 further including at least a second guide mounted on the transporter and coupled to the flare stack, the second guide being movable at least partially in a generally horizontal path and configured to help move the lower end of the flare stack rearward in the direction of the rear end of the transporter concurrently with the first guide helping guide the flare stack into at least one upright position.

10. The system of claim 9 wherein the first and second guides include respective first and second trolleys.

11. A system for moving a flare stack between at least one upright operating position and at least one lowered position and transporting the flare stack in at least one lowered position between desired locations, the flare stack having upper and lower ends, the system comprising:

a flare stack transporter having front and rear ends and being configured to secure the flare stack in at least one lowered position with its upper end closest to the rear end of the transporter and its lower end closest to the front end of the transporter for secure transport of the transporter and flare stack between desired locations; and at least first and second separate and distinct guides disposed the transporter, the first guide being engageable with the flare stack between the upper and lower ends thereof and the second guide being engageable with the flare stack between the first guide and the lower end of the flare stack, the first guide being moveable at least partially in a non-horizontal, linear, path on the transporter and configured to help guide the upper end of the flare stack upwardly to and downwardly from at least one upright operating position and the second guide being concurrently moveable at least partially in a generally horizontal path on the transporter and configured to help guide the lower end of the flare stack rearward in the direction of the rear end of the transporter.

12. The system of claim 11 wherein the first and second guides are separately pivotably coupled to the flare stack.

13. The system of claim 11 wherein the first guide is moveable along at least a first support and the second guide is concurrently movable along at least a second support, the first and second supports being separate and distinct.

14. The system of claim 13 wherein the first and second supports are I-beams.

15. The system of claim 11 further including a third support, wherein the first and third supports are angularly-oriented, parallel to and spaced apart from one another and the first guide is configured to move in an angular path along the first and third supports.

16. The system of claim 11 wherein the flare stack is transportable on the transporter between desired locations without the need for any selected from a group consisting of one or more tag lines, guide wires, T-stands, slings or lifting saddles.

17. A system for erecting a flare stack into at least one upright operating position, the flare stack having upper and lower ends, the system comprising:

a flare stack transporter having front and rear ends, wherein the flare stack can be carried on the transporter in a lowered position with its upper end closest to the rear end of the transporter and its lower end closest to the front end of the flare stack transporter;

at least a first retractor mounted on the transporter and associated with the flare stack, the first retractor being selectively actuated to help draw the lower end of the flare stack rearward in the direction of the rear end of the transporter; and at least a first trolly mounted on the transporter and associated with the flare stack, the first trolly being useful to help move the upper end of the flare stack upwardly until the flare stack is in at least one upright operating position, wherein the first trolly is movable along at least a first support on the transporter and pivotably coupled to the flare stack so that movement of the first trolly in the direction of the rear end of the transporter helps guide the flare stack into at least one upright operating position and movement of the first trolly in the direction of the front end of the transporter helps lower the flare stack into at least one lowered position.

18. The system of claim 17 wherein the first trolly is configured to help move the upper end of the flare stack upwardly concurrently with the rearward movement of the lower end of the flare stack.

19. The system of claim 17 wherein the first support is angularly-oriented support on the transporter and the first trolly is configured to move at least partially in an angular path along the first support.

20. The system of claim 17 further including at least a second trolly mounted on the transporter and coupled to the flare stack, the second trolly being movable at least partially in a generally horizontal path and configured to help move the lower end of the flare stack rearward in the direction of the rear end of the transporter concurrently with the first trolly helping guide the flare stack into at least one upright operating position.

21. A system for erecting a flare stack into at least one upright operating position, the flare stack having upper and lower ends, the system comprising:

a flare stack transporter having front and rear ends, wherein the flare stack can be carried on the transporter in a lowered position with its upper end closest to the rear end of the transporter and its lower end closest to the front end of the flare stack transporter;

at least a first retractor mounted on the transporter and associated with the flare stack, the first retractor being selectively actuated to help draw the lower end of the flare stack rearward in the direction of the rear end of the transporter;

at least a first trolly mounted on the transporter and associated with the flare stack, the first trolly being useful to help move the upper end of the flare stack upwardly until the flare stack is in at least one upright operating position; and at least a second trolly mounted on the transporter and coupled to the flare stack, the second trolly being movable at least partially in a generally horizontal path and configured to help move the lower end of the flare stack rearward in the direction of the rear end of the transporter concurrently with the first trolly helping guide the flare stack into at least one upright operating position.

22. A system for raising and lowering a flare stack between at least one upright position and at least one lowered position and raising and lowering a flare stack ignitor relative to the flare stack in at least one upright position, the flare stack having upper and lower ends, the system comprising:

a flare stack transporter having front and rear ends, wherein the flare stack can be carried on the transporter in at least one lowered position with its upper end closest to the rear end of the transporter and its lower end closest to the front end of the flare stack transporter;

at least a first guide mounted on the transporter and associated with the flare stack, the first guide being moveable at least partially in an angular path on the transporter and configured to help guide the upper end of the flare stack upwardly and downwardly between at least one upright position and at least one lowered position;

at least a second guide mounted on the transporter and coupled to the flare stack, the second guide being movable at least partially in a generally horizontal path and configured to help move the lower end of the flare stack rearward in the direction of the rear end of the transporter concurrently with the first guide helping guide the flare stack into at least one upright position;

a flare stack ignition boom carrying the flare stack igniter and being separate and distinct from the flare stack; and at least one connector coupled between the flare stack and the flare stack ignition boom and configured to allow the flare stack ignition boom to be selectively pivotably movable relative to the flare stack so that the flare stack igniter can be raised and lowered in a pivoting motion relative to the flare stack in at least one upright position.

23. The system of claim 22 wherein the first guide is pivotably coupled to the flare stack.

24. The system of claim 22 wherein the first and second guides include respective first and second trolleys.

* * * * *